US011573519B2

(12) United States Patent
Fumita et al.

(10) Patent No.: US 11,573,519 B2
(45) Date of Patent: Feb. 7, 2023

(54) ELECTROPHOTOGRAPHIC APPARATUS AND PROCESS CARTRIDGE

(71) Applicant: CANON KABUSHIKI KAISHA, Tokyo (JP)

(72) Inventors: Hidekazu Fumita, Shizuoka (JP); Kentaro Yamawaki, Shizuoka (JP); Sara Yoshida, Shizuoka (JP); Yusuke Kosaki, Shizuoka (JP); Taiji Katsura, Shizuoka (JP); Syoji Inoue, Shizuoka (JP); Arihiro Yamamoto, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/655,414

(22) Filed: Mar. 18, 2022

(65) Prior Publication Data

US 2022/0334530 A1 Oct. 20, 2022

(30) Foreign Application Priority Data

Apr. 6, 2021 (JP) ..... JP2021-064938

(51) Int. Cl.
*G03G 21/00* (2006.01)
*G03G 21/18* (2006.01)
(Continued)

(52) U.S. Cl.
CPC ..... *G03G 21/0017* (2013.01); *G03G 21/1814* (2013.01); *G03G 9/0819* (2013.01);
(Continued)

(58) Field of Classification Search
CPC ..... G03G 15/0812; G03G 15/0818; G03G 5/04; G03G 21/0011; G03G 21/0017; G03G 21/0029; G03G 21/1814
See application file for complete search history.

(56) References Cited

U.S. PATENT DOCUMENTS 4,517,273 A 5/1985 Inoue et al.
4,533,617 A 8/1985 Inoue et al.
(Continued)

FOREIGN PATENT DOCUMENTS

JP 2011-47988 A 3/2011
JP 2015-141360 A 8/2015
JP 2016-14740 A 1/2016

*Primary Examiner* — Hoang X Ngo
(74) *Attorney, Agent, or Firm* — Venable LLP

(57) ABSTRACT

The electrophotographic apparatus and process cartridge comprising an electrophotographic photosensitive member, a cleaning blade, and developing unit containing a toner, wherein the cleaning blade comprising a support member and an elastic member whose portion is abutting a surface of the electrophotographic photosensitive member; the elastic member has an elastic modulus of 15 to 470 MPa with coefficient of variation for the elastic modulus being not more than 7.0%, and the absolute value of a difference between Martens hardness values is not more than 0.30 $N/mm^2$ as measured under prescribed conditions; the toner contains a toner particle and an external additive whose a number-average primary particle diameter is from 5 to 25 nm, when X1 is a coverage ratio of the toner particle by the external additive and X2 is a theoretical coverage ratio, X1 is 50 to 85 area %, and $X1/X2 \geq -0.0042 \times X1 + 0.60$ is satisfied.

8 Claims, 5 Drawing Sheets

(51) Int. Cl.
*G03G 9/097* (2006.01)
*G03G 9/08* (2006.01)

(52) U.S. Cl.
CPC ..... *G03G 9/09708* (2013.01); *G03G 9/09725* (2013.01); *G03G 21/0011* (2013.01)

(56) References Cited

U.S. PATENT DOCUMENTS 4,535,048 A 8/1985 Inoue et al.
4,626,488 A 12/1986 Inoue
4,628,019 A 12/1986 Suematsu et al.
4,946,755 A 8/1990 Inoue
4,952,476 A 8/1990 Sakashita et al.
4,957,840 A 9/1990 Sakashita et al.
4,985,327 A 1/1991 Sakashita et al.
5,014,089 A 5/1991 Sakashita et al.
5,202,213 A 4/1993 Nakahara et al.
5,532,101 A 7/1996 Nozawa et al.
5,534,982 A 7/1996 Sakaizawa et al.
5,731,122 A 3/1998 Yoshida et al.
5,768,670 A 6/1998 Enomoto et al.
5,774,771 A 6/1998 Kukimoto et al.
5,915,150 A 6/1999 Kukimoto et al.
5,948,584 A 9/1999 Hashimoto et al.
5,998,080 A 12/1999 Ohno et al.
6,177,223 B1 1/2001 Hashimoto et al.
6,214,509 B1 4/2001 Kasuya et al.
6,300,024 B1 10/2001 Yusa et al.
6,337,169 B1 1/2002 Hashimoto et al.
6,528,224 B2 3/2003 Ohno et al.
6,627,374 B2 9/2003 Fumita et al.
6,696,211 B2 2/2004 Yoshida et al.
6,806,016 B2 10/2004 Ohno et al.
6,835,521 B2 12/2004 Tsuji et al.
6,951,704 B2 10/2005 Tsuji et al.
7,611,816 B2 11/2009 Tuji et al.
8,545,133 B2 10/2013 Fumita et al.
8,916,319 B2 12/2014 Ikeda et al.
8,940,467 B2 1/2015 Hashimoto et al.
9,309,349 B2 4/2016 Watanabe et al.
9,341,967 B2 5/2016 Tsujino et al.
9,366,981 B2 6/2016 Yamawaki et al.
9,429,860 B2 8/2016 Kinumatsu et al.
9,632,441 B2 4/2017 Abe et al.
9,658,554 B2 5/2017 Kinumatsu et al.
9,720,340 B2 8/2017 Tominaga et al.
9,733,583 B2 8/2017 Kuroki et al.
9,798,256 B2 10/2017 Kosaki et al.
9,798,262 B2 10/2017 Toyoizumi et al.
9,811,016 B2 11/2017 Aoki et al.
9,823,595 B2 11/2017 Toyoizumi et al.
9,857,713 B2 1/2018 Kosaki et al.
9,869,943 B2 1/2018 Aoki et al.
9,897,933 B2 2/2018 Yoshida et al.
9,952,532 B2 * 4/2018 Sugiyama ..... G03G 15/0818
10,054,866 B2 8/2018 Tanaka et al.
10,114,303 B2 10/2018 Katsura et al.
10,295,920 B2 5/2019 Nishikawa et al.
10,303,074 B2 5/2019 Yamawaki et al.
10,303,075 B2 5/2019 Tanaka et al.
10,409,180 B2 9/2019 Koji et al.
10,429,757 B2 10/2019 Yoshida et al.
10,503,090 B2 12/2019 Tominaga et al.
10,539,893 B2 1/2020 Tanaka et al.
10,539,899 B2 1/2020 Nakamura et al.
10,545,422 B2 1/2020 Yamawaki et al.
10,635,010 B2 4/2020 Kamikura et al.
10,635,011 B2 4/2020 Umeda et al.
10,754,265 B2 * 8/2020 Yamauchi ..... G03G 5/04
10,809,639 B2 10/2020 Yamawaki et al.
10,942,465 B2 3/2021 Kototani et al.
10,942,466 B2 3/2021 Tominaga et al.
10,976,678 B2 4/2021 Yamawaki et al.
10,976,679 B2 4/2021 Tanaka et al.
11,003,104 B2 5/2021 Katsura et al.
11,003,105 B2 5/2021 Sato et al.
11,112,712 B2 9/2021 Matsunaga et al.
11,169,460 B2 11/2021 Kototani et al.
11,249,408 B2 2/2022 Tsuda et al.
11,294,296 B2 4/2022 Fumita et al.
2001/0018158 A1 8/2001 Yoshida et al.
2015/0212445 A1 7/2015 Terasaki
2015/0248072 A1 9/2015 Katsuta et al.
2016/0004190 A1 1/2016 Nakamura
2021/0397110 A1 12/2021 Katsura et al.
2022/0121132 A1 4/2022 Yoshida et al.
2022/0121133 A1 4/2022 Yamawaki et al.

* cited by examiner

ELECTROPHOTOGRAPHIC APPARATUS AND PROCESS CARTRIDGE

BACKGROUND OF THE INVENTION

Field of the Invention

The present disclosure relates to a toner for developing an electrostatic image (electrostatic latent image) used in image-forming methods such as electrophotography and electrostatic printing, and further relates to an electrophotographic photosensitive member and an electrophotographic apparatus and a process cartridge containing the electrophotographic photosensitive member.

Description of the Related Art

Higher speeds and higher image quality stabilities have been required of copiers and printers in recent years. With regard to the toner, a high durability that can withstand higher speeds and the ability to bring about a long-life stabilization of image quality are being required at even higher levels. Japanese Patent Application Laid-open No. 2015-141360 discloses a toner that incorporates a thermosetting resin in a capsulation material that exhibits in the capsule film a hardness of from 1 N/m to 3 N/m. The idea is to provide the toner with resistance to high shear.

The following, on the other hand, has been proposed as a method for bringing about a long-life stabilization of image quality, that is, stable removal, using a cleaning blade, of the toner that remains present on the surface of an electrophotographic photosensitive member (also referred to hereafter simply as the "photosensitive member") implemented post-transfer. For example, Japanese Patent Application Laid-open No. 2016-14740 discloses a cleaning blade that contains a polyurethane material that contains a hard segment and a soft segment. This cleaning blade is composed of a polyurethane member for which the proportion, in the cross section thereof, of area occupied by hard segment aggregates having diameters in the range from 0.3 μm to 0.7 μm is from 2% to 10%. As a consequence of this, a method is disclosed which performs the stable cleaning of toner, and by which both chipping resistance and wear resistance are achieved.

Toner that has not been removed from the photosensitive member by cleaning (i.e., untransferred toner) stagnates or accumulates on the photosensitive member and may cause various image defects. Among the thusly produced image defects, there is strong desire for improvements in particular with regard to the starting streaks that are seen in the image as colored streaks. Starting streaks are described in the following.

Considering the behavior of the electrophotographic photosensitive member and cleaning blade during printing, aggregates of untransferred toner are formed at the tip region of the cleaning blade when a large number of prints are accumulated. When such aggregates are present, fusion of the aggregates to the electrophotographic photosensitive member readily occurs when printing is stopped because the aggregates are pressed against the electrophotographic photosensitive member by the pressure of the contact portion of the cleaning blade against the electrophotographic photosensitive member. When printing is restarted in this condition, some of the aggregates fused to the electrophotographic photosensitive member slip past the cleaning blade and are transferred to the charging member, causing poor charging and disturbing the latent image on the photosensitive member. In addition, whenever the charging member implements multiple rotations, e.g., two rotations or three rotations, image defects due to poor charging elicited by the same cause are produced at each rotation cycle of the charging member. Because this phenomenon is produced during starting after the cessation of printing, the image defects caused by this phenomenon are called starting streaks. In particular, Japanese Patent Application Laid-open No. 2011-47988 proposes that starting streaking be improved by the use of a fatty acid metal salt.

SUMMARY OF THE INVENTION

However, with the toner described in Japanese Patent Application Laid-open No. 2011-47988, the flowability of the toner undergoes a decline in the latter half of durability testing and problems associated with a decline in solid image compliance and poor toner charging performance may end up being produced.

When the art disclosed in Japanese Patent Application Laid-open No. 2015-141360 and Japanese Patent Application Laid-open No. 2016-14740 is used, it has also been found that, during the sped-up printing processes required in recent years, the cleaning performance declines in the latter half of durability testing in high-temperature environments and it is difficult to stop the occurrence of the starting streaks caused by toner fusion to the electrophotographic photosensitive member.

The present disclosure provides an electrophotographic apparatus and process cartridge that can provide a stable cleaning performance even during durability testing and that can suppress the occurrence of starting streaks in the latter half of durability testing in high-temperature, high-humidity environments.

The present invention discloses an electrophotographic apparatus comprising:

an electrophotographic photosensitive member having a support and a photosensitive layer on the support;

charging unit for charging a surface of the electrophotographic photosensitive member;

exposing unit for forming a latent image on the surface of the electrophotographic photosensitive member, by irradiating the surface of the electrophotographic photosensitive member with exposing light;

developing unit containing a toner and for forming a toner image on the surface of the electrophotographic photosensitive member by developing the latent image with the toner;

transferring unit for transferring the toner image on the surface of the electrophotographic photosensitive member to a transfer material; and a cleaning blade, wherein the cleaning blade comprises a polyurethane-containing elastic member, and a support member that supports the elastic member, the cleaning blade is disposed so that a portion of the elastic member is in contact with the surface of the electrophotographic photosensitive member;

when a side of the elastic member in contact with the surface of the electrophotographic photosensitive member is defined as a tip side of the elastic member, the elastic member has a plate shape at least at the tip side, the plate shape having a main surface and a tip surface that forms a tip side edge in combination with the main surface, the main surface facing the surface of the electrophotographic photosensitive member;

assuming that, on the tip surface, a hypothetical first line segment in parallel to the tip side edge at a distance of 10 μm from the tip side edge and having the same length as the tip side edge is drawn, designating a length of the first line segment as L, and defining, in the first line segment, P1 to be a point that is (1/10)L from one end of the first line segment, P2 to be a point that is (2/10)L from the one end of the first line segment, P3 to be a point that is (3/10)L from the one end of the first line segment, P4 to be a point that is (4/10)L from the one end of the first line segment, P5 to be a point that is (5/10)L from the one end of the first line segment, P6 to be a point that is (6/10)L from the one end of the first line segment, P7 to be a point that is (7/10)L from the one end of the first line segment, P8 to be a point that is (8/10)L from the one end of the first line segment, and P9 to be a point that is (9/10)L from the one end of the first line segment, and designating, on the first line segment, a total of 630 points comprising, centered on each of P1 to P9, 70 points at each of the P1 to P9 on a 1 μm pitch, an average value of elastic modulus values obtained by measurement at each of locations of the 630 points using a scanning probe microscope is from 15 MPa to 470 MPa and coefficient of variation for the elastic modulus is not more than 7.0%;

$|HM1-HM2| \leq 0.30\ N/mm^2$ where HM1 is Martens hardness of the elastic member measured at the location of P5 and HM2 is Martens hardness of the elastic member measured at the location that is a distance of 500 μm from the tip side edge on a bisector that is provided on supposition that a hypothetical bisector of an angle made between the main surface and the tip surface is drawn in a cross section of the elastic member that is orthogonal to the tip side edge and the tip surface that contains P5, the toner comprises a toner particle and an external additive, the external additive has a number-average primary particle diameter of 5 to 25 nm, when a coverage ratio on a surface of the toner particle by the external additive, as measured with an X-ray photoelectron spectrometer, is defined as X1, the X1 is from 50 to 85 area %, and when a theoretical coverage ratio on the surface of the toner particle by the external additive is defined as X2, a spreading index given by formula (1) below satisfies formula (2) below:

$$\text{spreading index} = X1/X2 \quad (1)$$

$$\text{spreading index} \geq -0.0042 \times X1 + 0.60 \quad (2)$$

The present invention discloses A process cartridge detachably disposed in an apparatus main body of an electrophotographic apparatus, the process cartridge comprising:

an electrophotographic photosensitive member having a support and a photosensitive layer on the support;

a developing unit containing a toner and for forming a toner image on a surface of the electrophotographic photosensitive member by developing a latent image formed on the surface of the electrophotographic photosensitive member with the toner; and a cleaning blade, wherein the cleaning blade comprises a polyurethane-containing elastic member, and a support member that supports the elastic member, the cleaning blade is disposed so that a portion of the elastic member is in contact with the surface of the electrophotographic photosensitive member, when a side of the elastic member in contact with the surface of the electrophotographic photosensitive member is defined as a tip side of the elastic member the elastic member has a plate shape at least at said tip side, the plate shape having a main surface and a tip surface that forms a tip side edge in combination with the main surface, the main surface facing the surface of the electrophotographic photosensitive member;

assuming that, on the tip surface, a hypothetical first line segment in parallel to the tip side edge at a distance of 10 μm from the tip side edge and having the same length as the tip side edge is drawn, designating a length of the first line segment as L, and defining, in the first line segment, P1 to be a point that is (1/10)L from one end of the first line segment, P2 to be a point that is (2/10)L from the one end of the first line segment, P3 to be a point that is (3/10)L from the one end of the first line segment, P4 to be a point that is (4/10)L from the one end of the first line segment, P5 to be a point that is (5/10)L from the one end of the first line segment, P6 to be a point that is (6/10)L from the one end of the first line segment, P7 to be a point that is (7/10)L from the one end of the first line segment, P8 to be a point that is (8/10)L from the one end of the first line segment, and P9 to be a point that is (9/10)L from the one end of the first line segment, and designating, on the first line segment, a total of 630 points comprising, centered on each of P1 to P9, of 70 points at each of the P1 to P9 on a 1 μm pitch, an average value of elastic modulus values obtained by measurement at each of locations of the 630 points using a scanning probe microscope is from 15 MPa to 470 MPa and coefficient of variation for the elastic modulus is not more than 7.0%, $|HM1-HM2| \leq 0.30\ N/mm^2$ where HM1 is Martens hardness of the elastic member measured at the location of P5 and HM2 is Martens hardness of the elastic member measured at the location that is a distance of 500 μm from the tip side edge on a bisector that is provided on supposition that a hypothetical bisector of an angle made between the main surface and the tip surface is drawn in a cross section of the elastic member that is orthogonal to the tip side edge and the tip surface that contains P5, the toner comprises a toner particle and an external additive, the external additive has a number-average primary particle diameter of 5 to 25 nm;

when a coverage ratio on a surface of the toner particle by the external additive, as measured with an X-ray photoelectron spectrometer, is defined as X1, the X1 is from 50 to 85 area %, and when a theoretical coverage ratio on the surface of the toner particle by the external additive is defined as X2, a spreading index given by formula (1) below satisfies formula (2) below:

$$\text{spreading index}=X1/X2 \quad (1)$$

$$\text{spreading index} \geq -0.0042 \times X1+0.60 \quad (2)$$

The present disclosure can thus provide an electrophotographic apparatus and process cartridge that can provide a stable cleaning performance even during durability testing and that can suppress the occurrence of starting streaks in the latter half of durability testing in high-temperature, high-humidity environments.

Further features of the present invention will become apparent from the following description of exemplary embodiments with reference to the attached drawings.

DESCRIPTION OF THE EMBODIMENTS

Figure 1:
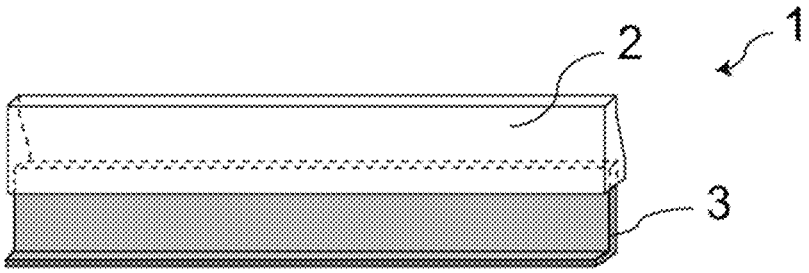
FIG. 1 is a schematic perspective diagram of an example of a cleaning blade.

Preferred embodiments of the present disclosure are described in the following with reference to the figures, but the present disclosure is not limited to or by the following embodiments. In the present disclosure, the expression of "from XX to YY" or "XX to YY" indicating a numerical range means a numerical range including a lower limit and an upper limit which are end points, unless otherwise specified. Also, when a numerical range is described in a stepwise manner, the upper and lower limits of each numerical range can be arbitrarily combined. In the following description, the same number is assigned in the figures to structures that have the same function, and in some instances a description thereof may be omitted.

The present disclosure relates to the electrophotographic apparatus comprising:

an electrophotographic photosensitive member having a support and a photosensitive layer on the support;

charging unit for charging a surface of the electrophotographic photosensitive member;

exposing unit for forming a latent image on the surface of the electrophotographic photosensitive member, by irradiating the surface of the electrophotographic photosensitive member with exposing light;

developing unit containing a toner and for forming a toner image on the surface of the electrophotographic photosensitive member by developing the latent image with the toner;

transferring unit for transferring the toner image on the surface of the electrophotographic photosensitive member to a transfer material; and a cleaning blade, wherein the cleaning blade comprises a polyurethane-containing elastic member, and a support member that supports the elastic member, the cleaning blade is disposed so that a portion of the elastic member is in contact with the surface of the electrophotographic photosensitive member;

when a side of the elastic member in contact with the surface of the electrophotographic photosensitive member is defined as a tip side of the elastic member, the elastic member has a plate shape at least at the tip side, the plate shape having a main surface and a tip surface that forms a tip side edge in combination with the main surface, the main surface facing the surface of the electrophotographic photosensitive member;

assuming that, on the tip surface, a hypothetical first line segment in parallel to the tip side edge at a distance of 10 μm from the tip side edge and having the same length as the tip side edge is drawn, designating a length of the first line segment as L, and defining, in the first line segment, P1 to be a point that is (1/10)L from one end of the first line segment, P2 to be a point that is (2/10)L from the one end of the first line segment, P3 to be a point that is (3/10)L from the one end of the first line segment, P4 to be a point that is (4/10)L from the one end of the first line segment, P5 to be a point that is (5/10)L from the one end of the first line segment, P6 to be a point that is (6/10)L from the one end of the first line segment, P7 to be a point that is (7/10)L from the one end of the first line segment, P8 to be a point that is (8/10)L from the one end of the first line segment, and P9 to be a point that is (9/10)L from the one end of the first line segment, and designating, on the first line segment, a total of 630 points comprising, centered on each of P1 to P9, 70 points at each of the P1 to P9 on a 1 μm pitch, an average value of elastic modulus values obtained by measurement at each of locations of the 630 points using a scanning probe microscope is from 15 MPa to 470 MPa and coefficient of variation for the elastic modulus is not more than 7.0%;

$|HM1-HM2| \leq 0.30$ N/mm$^2$ where HM1 is Martens hardness of the elastic member measured at the location of P5 and HM2 is Martens hardness of the elastic member measured at the location that is a distance of 500 μm from the tip side edge on a bisector that is provided on supposition that a hypothetical bisector of an angle made between the main surface and the tip surface is drawn in a cross section of the elastic member that is orthogonal to the tip side edge and the tip surface that contains P5, the toner comprises a toner particle and an external additive, the external additive has a number-average primary particle diameter of 5 to 25 nm, when a coverage ratio on a surface of the toner particle by the external additive, as measured with an X-ray photoelectron spectrometer, is defined as X1, the X1 is from 50 to 85 area %, and when a theoretical coverage ratio on the surface of the toner particle by the external additive is defined as X2, a spreading index given by formula (1) below satisfies formula (2) below:

$$\text{spreading index}=X1/X2 \quad (1)$$

$$\text{spreading index}\geq -0.0042\times X1+0.60 \quad (2)$$

The present disclosure relates to the process cartridge detachably disposed in an apparatus main body of an electrophotographic apparatus, the process cartridge comprising:

an electrophotographic photosensitive member having a support and a photosensitive layer on the support;

a developing unit containing a toner and for forming a toner image on a surface of the electrophotographic photosensitive member by developing a latent image formed on the surface of the electrophotographic photosensitive member with the toner; and a cleaning blade, wherein the cleaning blade comprises a polyurethane-containing elastic member, and a support member that supports the elastic member, the cleaning blade is disposed so that a portion of the elastic member is in contact with the surface of the electrophotographic photosensitive member, when a side of the elastic member in contact with the surface of the electrophotographic photosensitive member is defined as a tip side of the elastic member the elastic member has a plate shape at least at said tip side, the plate shape having a main surface and a tip surface that forms a tip side edge in combination with the main surface, the main surface facing the surface of the electrophotographic photosensitive member;

assuming that, on the tip surface, a hypothetical first line segment in parallel to the tip side edge at a distance of 10 μm from the tip side edge and having the same length as the tip side edge is drawn, designating a length of the first line segment as L, and defining, in the first line segment, P1 to be a point that is (1/10)L from one end of the first line segment, P2 to be a point that is (2/10)L from the one end of the first line segment, P3 to be a point that is (3/10)L from the one end of the first line segment, P4 to be a point that is (4/10)L from the one end of the first line segment, P5 to be a point that is (5/10)L from the one end of the first line segment, P6 to be a point that is (6/10)L from the one end of the first line segment, P7 to be a point that is (7/10)L from the one end of the first line segment, P8 to be a point that is (8/10)L from the one end of the first line segment, and P9 to be a point that is (9/10)L from the one end of the first line segment, and designating, on the first line segment, a total of 630 points comprising, centered on each of P1 to P9, of 70 points at each of the P1 to P9 on a 1 μm pitch, an average value of elastic modulus values obtained by measurement at each of locations of the 630 points using a scanning probe microscope is from 15 MPa to 470 MPa and coefficient of variation for the elastic modulus is not more than 7.0%, $|HM1-HM2|\leq 0.30\ N/mm^2$ where HM1 is Martens hardness of the elastic member measured at the location of P5 and HM2 is Martens hardness of the elastic member measured at the location that is a distance of 500 μm from the tip side edge on a bisector that is provided on supposition that a hypothetical bisector of an angle made between the main surface and the tip surface is drawn in a cross section of the elastic member that is orthogonal to the tip side edge and the tip surface that contains P5, the toner comprises a toner particle and an external additive, the external additive has a number-average primary particle diameter of 5 to 25 nm;

when a coverage ratio on a surface of the toner particle by the external additive, as measured with an X-ray photoelectron spectrometer, is defined as X1, the X1 is from 50 to 85 area %, and when a theoretical coverage ratio on the surface of the toner particle by the external additive is defined as X2, a spreading index given by formula (1) below satisfies formula (2) below:

$$\text{spreading index}=X1/X2 \quad (1)$$

$$\text{spreading index}\geq -0.0042\times X1+0.60 \quad (2)$$

The cleaning blade is provided with a polyurethane-containing elastic member and with a support member that supports the elastic member, and is disposed so a portion of the elastic member is in contact with the surface of the electrophotographic photosensitive member. The cleaning blade cleans the surface of the electrophotographic photosensitive member due to this disposition of the cleaning blade. The portion of the elastic member that contacts the surface of the electrophotographic photosensitive member is in some instances referred to as the "contact portion" in the following.

Defining the tip side of the cleaning blade to be the side of the cleaning blade in contact with the surface of the member to be cleaned, the elastic member has, at least at the tip side, a plate shape that has a main surface facing the electrophotographic photosensitive member and a tip surface that in combination with the main surface forms a tip side edge.

Structure of the Cleaning Blade

FIG. 1 is a schematic perspective diagram of an example of a cleaning blade. The cleaning blade 1 is provided with an elastic member 2 and a support member 3 that supports the elastic member 2.

Figure 2:
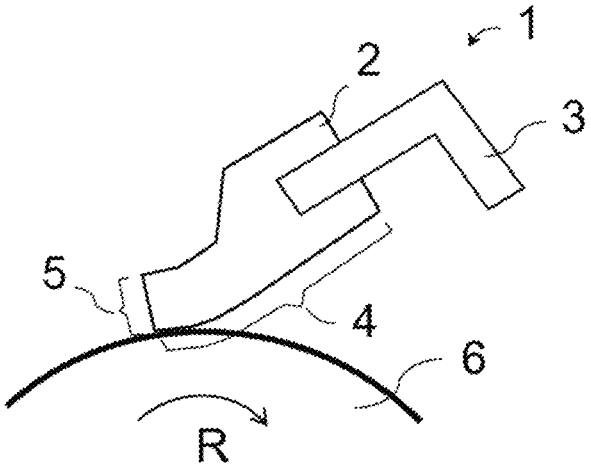
FIG. 2 is a cross-sectional schematic diagram of a condition in which the edge of a cleaning blade is in contact with the surface of an electrophotographic photosensitive member.

FIG. 2 is a cross-sectional schematic diagram of a condition in which the edge of the cleaning blade 1 is in contact with the surface of an electrophotographic photosensitive member 6. The elastic member 2 has a main surface 4, which faces the surface of the electrophotographic photosensitive member 6, and has a tip surface 5, which in combination with the main surface 4 forms a tip side edge. The R indicates the direction of rotation of the electrophotographic photosensitive member 6.

By providing the cleaning blade with the structure described in the following, the present inventors obtained the effect of enhancing the cleaning performance on a long-term basis even in high-temperature, high-humidity environments.

Figure 3:
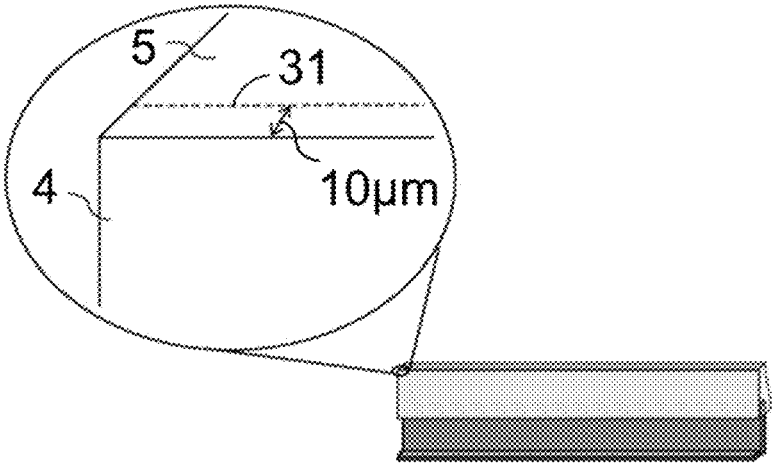
FIG. 3 is a diagram that shows a first line segment residing at a distance of 10 μm from the tip side edge.
Figure 4:
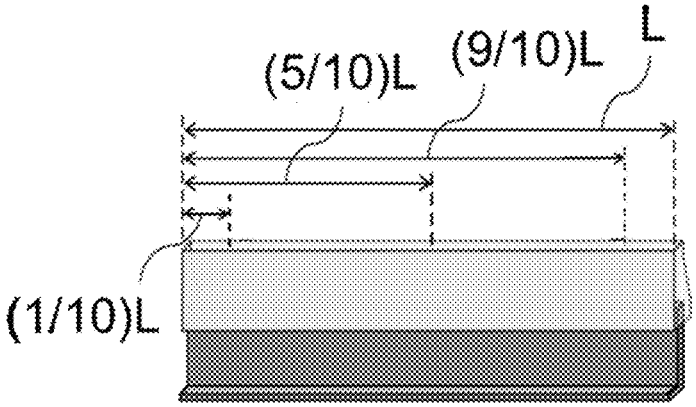
FIG. 4 is a diagram that shows the point on the first line segment that is (1/10)L, the point on the first line segment that is (5/10)L, and the point on the first line segment that is (9/10)L from one end of the first line segment.
Figure 5:
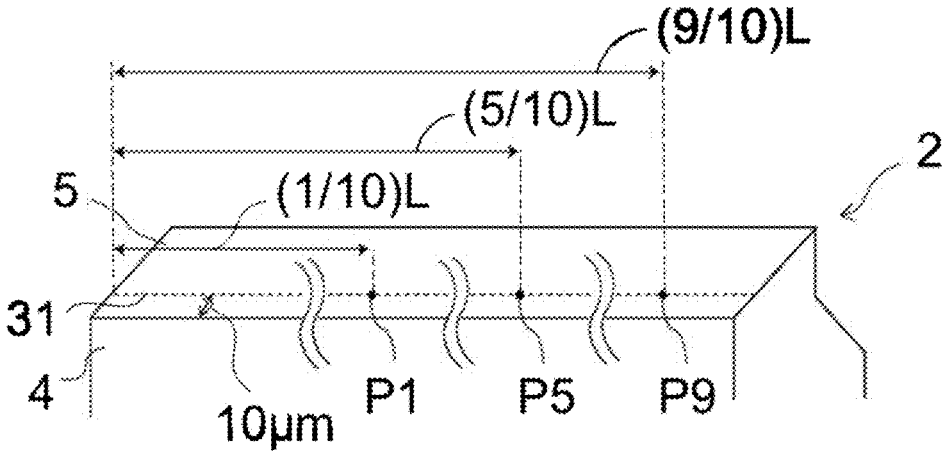
FIG. 5 is a diagram that shows the location of P1, P5, and P9.

A hypothetical first line segment 31 is drawn, on the tip surface 5 of the elastic member, in parallel to the tip side edge at a distance of 10 μm from the tip side edge and with the same length as the tip side edge. The length of the first line segment 31 is defined as L. The following are defined in the first line segment 31: P1=the point that is (1/10)L from one end of the first line segment 31 (from one end of the tip surface 5); P2=the point that is (2/10)L from the one end of the first line segment 31; P3=the point that is (3/10)L from the one end of the first line segment 31; P4=the point that is (4/10)L from the one end of the first line segment 31; P5=the point that is (5/10)L from the one end of the first line segment 31; P6=the point that is (6/10)L from the one end of the first line segment 31; P7=the point that is (7/10)L from the one end of the first line segment 31; P8=the point that is (8/10)L from the one end of the first line segment 31; and P9=the point that is (9/10)L from the one end of the first line segment 31 (refer to FIG. 3, FIG. 4, and FIG. 5).

When a total of 630 points—consisting, centered on each of P1 to P9, of 70 points at each thereof on a 1 μm pitch—are defined in the first line segment 31, the average value of the elastic modulus values obtained by measurement at each of the locations of the 630 points using a scanning probe microscope (also referred to in the following simply as an SPM) is from 15 MPa to 470 MPa.

The occurrence of poor cleaning can be suppressed because the contact pressure required for cleaning can be obtained when the average value of these elastic modulus values is at least 15 MPa and because, at not more 470 MPa, an excessive hardness is avoided and compliance with the image bearing member, e.g., the photosensitive member, is then good.

As the number of prints in a durability test grows larger, due to rubbing with the contact member under a condition in which fine particle-containing toner is present, the surface of the image bearing member, e.g., the photosensitive member, is inscribed and a streak-shaped unevenness is elaborated in the circumferential direction. As a consequence, the occurrence of poor cleaning is facilitated when compliance is poor. However, then the elastic modulus is not more 470 MPa, the surface of the image bearing member, e.g., the photosensitive member, engages in compliance even in a condition in which streak-shaped unevenness has been acquired, and the occurrence of poor cleaning can be suppressed as a consequence. The average value of the elastic modulus values is preferably from 15 MPa to 460 MPa and is more preferably from 15 MPa to 70 MPa. The average value of the elastic modulus values can be adjusted by, for example, changing the compositions of the curing agent and/or prepolymer that constitute the polyurethane contained in the elastic member, and/or subjecting the elastic member to a surface treatment as described below.

The coefficient of variation for the elastic modulus of the elastic member is not more than 7.0% and is preferably not more than 6.0% and more preferably not more than 5.0%. The lower limit for this coefficient of variation is not particularly limited, but is, for example, greater than or equal to 0.0%. The coefficient of variation is calculated using the following formula.

coefficient of variation=standard deviation on the elastic modulus/average value of the elastic modulus×100

This coefficient of variation is an index that represents the degree of aggregation or segregation in the hard segments in the elastic modulus. In the present disclosure, this coefficient of variation must be not more than 7.0%, i.e., there must be little aggregation or segregation of the hard segments and they must be uniformly present. Due to the uniform application of force to the contact portion with the photosensitive member when this coefficient of variation is not more than 7.0%, not only can the occurrence of poor cleaning be suppressed, but there is little area where a locally strong force is applied to toner also present between the elastic member and the photosensitive member, and force can be uniformly applied. This coefficient of variation can be adjusted by, for example, changing the compositions of the curing agent and/or prepolymer that constitute the polyurethane contained in the elastic member, and/or subjecting the elastic member to a surface treatment as described below.

However, when hard segment aggregation is promoted, the hard segment grows large and locations where the hard segment is concentrated end up being present. As a result, the elastic member may then end up applying a locally strong force to the contact portion with the photosensitive member and to the toner present between it and the photosensitive member. In this case, the external additive, e.g., silica, is detached from the toner surface and toner is produced in which areas not coated by external additive are prominently present; this ends up causing the production of starting streaks that originate with toner fusion to the photosensitive member. When hard segment aggregation advances, separation between hard segments and soft segments proceeds at the same time. When the elastic modulus is measured using an SPM on a cleaning blade in this state at the 70 points on a 1 μm pitch, numerical values are individually detected for the hard segment or soft segment, respectively, and the coefficient of variation for the elastic modulus is then large even though the average value of the elastic modulus is in the range indicated above. That is, when the coefficient of variation is larger than 7.0%, locations are produced where aggregated hard segments have segregated, such that a locally strong force is applied to the toner, and starting streaks that originate with toner fusion to the photosensitive member then end up being produced.

In addition, even if the coefficient of variation is brought to less than or equal to 7.0% by reducing the amount of hard segment and increasing the soft segment moiety, when the elastic modulus is less than 15 MPa a contact pressure is not adequately applied and streak-shaped image defects, which are produced by the toner slipping past, may be produced. Compared with this condition, with the cleaning blade according to the present disclosure, hard segment aggregation is suppressed and the hard segments are microfinely dispersed and this dispersion is uniform without segregation. Due to this, when the elastic modulus is measured using an SPM that has a very small probe contact area, the scatter in the numerical values among the measurement values is also small. Consequently, when the elastic modulus is measured at 70 points on a 1 μm pitch at each of the P1 to P9 points (9 points×70 points, for a total of 630), the average value of the elastic modulus values is from 15 MPa to 470 MPa and the coefficient of variation thereon is not more than 7.0%.

When the elastic member as a whole assumes such a state of hard segment microdispersion, there is then little area that applies excessive force to the photosensitive member or toner and force can be uniformly applied, and as a consequence the generation of starting streaks that originate with toner fusion to the photosensitive member can be suppressed. The generation of toner fusion to the photosensitive member is facilitated in particular in high-temperature environments when—due, based on the temperature characteristics of urethane elastomers, to a lowered viscosity and a tendency for the contact pressure to increase—aggregated hard segments undergo segregation and locations are present where force is locally applied. The cleaning blade according to the present disclosure can suppress toner fusion to the photosensitive member and as a consequence can suppress the generation of starting streaks in high-temperature environments.

Hard segment aggregation can be suppressed through the introduction into the hard segment of a structure that exhibits a low regularity or a low crystallinity. In addition, soft segment aggregation readily occurs when the soft segment also exhibits a high crystallinity, with the result that dispersion of the hard segment ends up being impeded. Due to this, the introduction of a low-crystallinity structure into the soft segment can also suppress hard segment aggregation.

HM1 is defined as follows. A hypothetical first line segment is drawn on the tip surface of the elastic member in parallel to the tip side edge at a distance of 10 μm from the tip side edge and having the same length as the tip side edge. The length of this first line segment is designated L. HM1 is the Martens hardness of the elastic member measured at the location on the first line segment of the point that is (5/10)L from one end of the first line segment (the location of P5 as described above).

Figure 6:
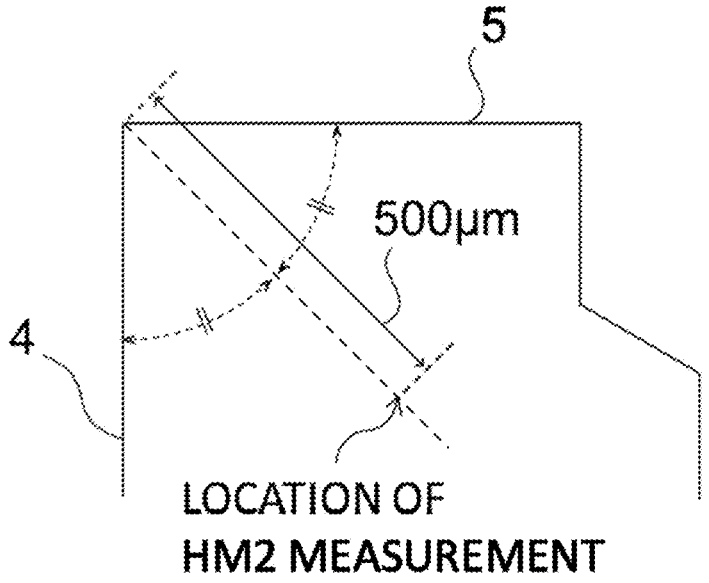
FIG. 6 is a diagram that shows the location where measurement of the Martens hardness HM2 is made.

HM2 is defined as the Martens hardness of the elastic member measured at a location that is a distance of 500 μm from the tip side edge on a bisector that is provided by drawing a hypothetical bisector of the angle made between the main surface 4 and the tip surface 5 in a cross section of the elastic member that is orthogonal to the tip side edge and the tip surface 5 that contains P5 (refer to FIG. 6). The absolute value of the difference between HM1 and HM2 (the value of |HM1−HM2|) is not more than 0.30 $N/mm^2$ in the elastic member according to the present disclosure. This absolute value is preferably not more than 0.10 $N/mm^2$ and is more preferably not more than 0.05 $N/mm^2$. The lower limit on this absolute value is not particularly limited, but is, for example, greater than or equal to 0.00 $N/mm^2$.

Surface treatment of the elastic member is also useful as a means for providing a uniform hardness of the surface.

It is important for the elastic member that the hardness difference between the interior and surface of the elastic member be small and that the hardness be uniform from the surface into the interior. That is, when the absolute value of the difference between HM1 and HM2 (the value of |HM1−HM2|) is not more than 0.30 $N/mm^2$, there is then little area that applies a locally strong force to the photosensitive member or toner and the generation of starting streaks that originate with toner fusion to the photosensitive member can be prevented. When, on the other hand, the value of |HM1−HM2| exceeds 0.30 $N/mm^2$, a large difference is then established for the difference between the hardness of the surface of the elastic member and its interior, and the layer that has assumed a higher hardness readily chips at boundary regions and problems with the durability are produced.

The Support Member

The material constituting the support member of the cleaning blade is not particularly limited, and, for example, the following materials can be used: metal materials such as steel sheet, stainless steel sheet, zinc-plated steel sheet, chromium-free steel sheet, and so forth, and resin materials such as nylon-6, nylon-6,6, and so forth. The structure of the support member is also not particularly limited. Preferably one end of the elastic member of the cleaning blade is supported by the support member as shown in, for example, FIG. 2.

The Elastic Member

The polyurethane contained in the elastic member is preferably a polyurethane elastomer. Polyurethane elastomers are obtained from starting materials comprising mainly a polyol, chain extender, polyisocyanate, catalyst, other additives, and so forth. This polyurethane elastomer is a block copolymer composed of hard segments and soft segments. The hard segments are generally formed from polyisocyanate and a chain extender that contains a short-chain diol. The soft segments, on the other hand, are generally formed from polyisocyanate and a long-chain polyol such as a polyester polyol, polyether polyol, polycarbonate polyol, and so forth. The content of the polyurethane in the elastic member is preferably 90 mass % to 100 mass %.

Examples of the polyol are as follows: polyester polyols such as polyethylene adipate polyol, polybutylene adipate polyol, polyhexylene adipate polyol, (polyethylene/polypropylene) adipate polyol, (polyethylene/polybutylene) adipate polyol, and (polyethylene/polyneopentylene) adipate polyol; polycaprolactone polyols obtained by the ring-opening polymerization of caprolactone; polyether polyols such as polyethylene glycol, polypropylene glycol, and polytetramethylene glycol; and polycarbonate diols. A single one of these may be used by itself or two or more may be used in combination.

Among these polyols, a polyester polyol that uses adipate is preferred because this yields a polyurethane elastomer that exhibits excellent mechanical characteristics. In particular, such a polyester polyol that uses a glycol having at least 4 carbons, e.g., polybutylene adipate polyol, polyhexylene adipate polyol, and so forth, is more preferred. In addition, the co-use of polyols in which the glycols have different numbers of carbon, e.g., polybutylene adipate polyol plus polyhexylene adipate polyol, is preferred. The presence of different polyol species enables a better suppression of soft segment crystallization and a better suppression of hard segment aggregation.

A glycol, or an at least trifunctional polyhydric alcohol, that supports extension of the polyurethane elastomer chain can also be used as the aforementioned chain extender. The glycol can be exemplified by the following: ethylene glycol (EG), diethylene glycol (DEG), propylene glycol (PG), dipropylene glycol (DPG), 1,4-butanediol (1,4-BD), 1,6-hexanediol (1,6-HD), 1,4-cyclohexanediol, 1,4-cyclohexanedimethanol, xylylene glycol (terephthalyl alcohol), and triethylene glycol. A single one of these may be used by itself or a combination of two or more may be used.

The at least trifunctional polyhydric alcohol can be exemplified by trimethylolpropane, glycerol, pentaerythritol, and sorbitol. A single one of these may be used by itself or a combination of two or more may be used.

The introduction of crosslinking is an example of one method that can be used to raise the elastic modulus of polyurethane elastomers. The use of an at least trifunctional polyhydric alcohol in the chain extender is a preferred method for introducing crosslinking. In addition, when the branching becomes overly extensive, it is then difficult for all the hydroxyl groups to undergo reaction and obtaining the desired degree of crosslinking is impeded. As a consequence, the use, among polyhydric alcohols, of a trifunctional alcohol is more preferred. The use of trimethylolpropane (TMP) is more preferred: because it has a methylene skeleton adjacent to the hydroxyl group, a flexible crosslink structure is assumed in terms of molecular structure and trimethylolpropane then also accrues the effect of suppressing hard segment crystallization.

The concentration of the trifunctional alcohol, as calculated using the following formula (3), is preferably 0.22 mmol/g to 0.39 mmol/g. At greater than or equal to 0.22 mmol/g, the inhibitory effect on hard segment aggregation is very high and edge chipping of the cleaning blade can be more substantially suppressed. At less than or equal to 0.39 mmol/g, the elastic modulus is then not increased to an excessive degree by the introduction of crosslinking, and as a consequence the generation of poor cleaning can be further suppressed due to a very good compliance versus the image bearing member.

[Math. 1]

$$\text{trifunctional alcohol concentration (mmol/g)} = \frac{\text{(amount of trifunctional alcohol (g)/ molecularweight of trifunctional alcohol)} \times 1000)}{\text{(polyurethane elastomer mass (g)}} \quad (3)$$

The polyisocyanate can be exemplified by the following: 4,4'-diphenylmethane diisocyanate (4,4'-MDI), polymeric MDI, 2,4-tolylene diisocyanate (2,4-TDI), 2,6-tolylene diisocyanate (2,6-TDI), xylene diisocyanate (XDI), 1,5-naphthalene diisocyanate (1,5-NDI), p-phenylene diisocyanate (PPDI), hexamethylene diisocyanate (HDI), isophorone diisocyanate (IPDI), 4,4'-dicyclohexylmethane diisocyanate (hydrogenated MDI), tetramethylxylene diisocyanate (TMXDI), and carbodiimide-modified MDI. Among the preceding, 4,4'-MDI is preferred because its two isocyanate groups have the same reactivity and it yields high mechanical characteristics. In addition, the co-use of polymeric MDI is more preferred due to its very high inhibitory effect on hard segment aggregation because the hard segment-forming polyisocyanate itself has a branched structure.

Those catalysts generally used for the curing of polyurethane elastomers can be used as the aforementioned catalyst. Tertiary amine catalysts are examples of this catalyst, and the following are specific examples: aminoalcohols such as dimethylethanolamine, N,N,N'-trimethylaminopropylethanolamine, and N,N'-dimethylhexanolamine; trialkylamines such as triethylamine; tetraalkyldiamines such as N,N,N,N'-tetramethyl-1,3-butanediamine; triethylenediamine; piperazine compounds; and triazine compounds. The organic acid salts of metals can also be used, e.g., potassium acetate and alkali potassium octylate. The metal catalysts generally used for urethanations, for example, dibutyltin dilaurate, can also be used. A single one of these may be used alone or two or more may be used in combination.

Additives, e.g., pigments, plasticizers, waterproofing agents, oxidation inhibitors, ultraviolet absorbers, photostabilizers, and so forth, may be blended on an optional basis into the starting materials for the elastic member.

Methods for Producing the Cleaning Blade

There are no particular limitations on the method for producing the cleaning blade, and a suitable method may be selected from among known methods. For example, a cleaning blade in which a plate-shaped blade member and a support member are unified into a single article can be obtained by placing the support member in a mold for the cleaning blade, then injecting the aforementioned polyurethane starting material composition into the cavity, and heating and curing. The following method can also be used: a polyurethane elastomer sheet can be separately molded from the aforementioned polyurethane starting material composition, this can be cut into a strip to give the elastic member, the bonding region of the elastic member can be overlaid on the support member, on which an adhesive has been coated or attached, and bonding can be carried out by the application of heat and pressure.

The elastic modulus measured with an SPM on the tip surface of the cleaning blade can be increased by carrying out a surface treatment. An ultraviolet-generating light source is used for this surface treatment step. In particular, the wavelength of the maximum emission peak is preferably in the vicinity of 254 nm, for example, in the range of 254±1 nm. This is because ultraviolet light at this wavelength or in this wavelength region can efficiently produce active oxygen, which causes modification of the polyurethane surface. When a plurality of ultraviolet emission peaks are present, preferably one of them is present in the vicinity of 254 nm.

The intensity of the light emitted from the light source is not particularly limited, and the value as measured using, for example, a spectral irradiance meter (USR-40V/D, Ushio Inc.) or an accumulated UV meter (UIT-150-A, UVD-S254, VUV-S172, and VUV-S365, Ushio Inc.), can be used. The accumulated amount of ultraviolet radiation irradiated on the polyurethane in the surface treatment step may be selected as appropriate in conformity to the effects obtained from the surface treatment. For example, the irradiation time by the light from the light source, the light source output, the distance from the light source, and so forth may be established so as to provide a desired accumulated light dose, e.g., 10,000 mJ/cm$^2$.

The accumulated light dose for the ultraviolet radiation irradiated on the elastic member can be calculated using the following method.

accumulated dose of ultraviolet radiation (mJ/cm$^2$)=intensity of the ultraviolet radiation (mW/cm$^2$)×irradiation time (sec)

For example, a high-pressure mercury lamp or a low-pressure mercury lamp can be suitably used as the ultraviolet-emitting light source. These light sources are preferred because they can stably emit ultraviolet radiation at a suitable wavelength with little attenuation due to irradiation distance and because they can easily uniformly irradiate the entire surface.

The Process Cartridge and Electrophotographic Apparatus

The cleaning blade described in the preceding can be used by incorporation in a process cartridge that is detachably disposed in the apparatus main body of an electrophotographic apparatus. The process cartridge, for example, has a toner and an electrophotographic photosensitive member that has a support and a photosensitive layer on the support, and is provided with a cleaning blade and a developing unit for forming a toner image on the surface of the electrophotographic photosensitive member by developing, with the toner, a latent image that has been formed on the surface of the electrophotographic photosensitive member. The cleaning blade described in the preceding can be used in such a process cartridge. The process cartridge may be further provided with a toner container, a toner feed roller, a developing roller, a charging roller, and so forth. This process cartridge contributes to the stable formation of high-quality electrophotographic images.

In addition, the electrophotographic apparatus has an electrophotographic photosensitive member that has a support and a photosensitive layer on the support; a charging unit that charges the surface of the electrophotographic photosensitive member; a exposing unit that forms a latent image on the surface of the electrophotographic photosensitive member by irradiating a exposing light onto the surface of the electrophotographic photosensitive member; and a toner. The electrophotographic apparatus is also provided with a developing unit for forming a toner image on the electrophotographic photosensitive member by developing the latent image with the toner; a transfer unit for transferring the toner image to a transfer material; and a cleaning blade. The cleaning blade described in the preceding can be used in such an electrophotographic apparatus.

This electrophotographic apparatus can stably form high-quality electrophotographic images.

The Toner

In addition to the improvements in the cleaning blade as described in the preceding, it is necessary in the present disclosure that a condition be established wherein the amount of external additive present as aggregates on the toner particle surface is small and the amount present as primary particles is large. Even when a configuration is established in which force is uniformly applied to the toner, as with the cleaning blade according to the present disclosure, and detachment of the external additive, e.g., silica fine particles, from the toner particle surface is suppressed, a large area not coated by external additive ends up being present when the external additive assumes an aggregated condition on the surface of the toner particle that is used, and this is connected to the generation of starting streaks that are caused by toner fusion to the drum. In addition, when the external additive is present as aggregates on the toner surface, and when the aggregates transfer to the photosensitive member, toner fusion is produced with these aggregates as a starting point and this can end up being associated with the generation of starting streaks.

Thus, both of the following improvements are necessary in the present disclosure in order to stop the generation of starting streaks that originate with toner fusion to the drum: the improvements to the cleaning blade according to the present disclosure, and establishing a condition in which a large amount of the external additive on the toner particle surface is present as primary particles.

The number-average primary particle diameter of the external additive is from 5 nm to 25 nm. When this number-average particle diameter is less than 5 nm, the van der Waals forces acting external additive-to-external additive are excessively strong and external additive-to-external additive electrostatic aggregation occurs, and the external additive will then readily detach from the toner particle surface. In addition, when this number-average particle diameter is greater than 25 nm, the van der Waals forces between the toner particle surface and external additive decline and the external additive will then readily detach from the toner particle surface. This number-average particle diameter is preferably 6 nm to 20 nm and is more preferably 6 nm to 17 nm.

In addition, the coverage ratio X1 of the toner particle surface by the external additive, as measured with an X-ray photoelectron spectrometer (also denoted as ESCA in the following), is from 50 area % to 85 area %. When this range is observed, the external additive particles are in close proximity to each other and, due to interaction via van der Waals forces, a condition can be produced in which detachment of the external additive from the toner particle surface is impeded.

Control of the mixing conditions for the external additive is an example of a method for bringing the coverage ratio X1 into the indicated range. When the coverage ratio X1 is less than 50 area %, the distance between external additive particles is too large, the van der Waals force-based interactions are then inadequate, detachment of the external additive from the toner particle surface cannot be adequately stopped, and the generation of starting streaks cannot be prevented. When the coverage ratio is larger than 85 area %, a condition is provided in which detachment is impeded, but it may not be possible to suppress the occurrence of starting streaks in high-temperature, high-humidity environments, and/or the cleaning performance may end up declining during durability testing. The coverage ratio X1 is preferably from 50 area % to 80 area % and is more preferably from 60 area % to 80 area %.

Defining X2 as the theoretical coverage of the toner particle surface by the external additive, the spreading index given by the following formula (1) satisfies the following formula (2).

$$\text{spreading index}=X1/X2 \quad (1)$$

$$\text{spreading index}\geq -0.0042\times X1+0.60 \quad (2)$$

The indicated coverage ratio X1 is calculated as follows.

(i) The detected intensity Xa of a characteristic atom constituting the external additive is determined by ESCA measurement of the pure external additive.

(ii) A toner sample is then measured by ESCA to determine the detected intensity Xb of an atom originating with the external additive (the same atom as in (i)).

The coverage ratio X1 is determined as the ratio between Xb and Xa (Xb/Xa). For example, when silica fine particles are used as the external additive, it can be determined as the ratio of the detected intensity for the Si atom when the toner is measured by ESCA, to the detected intensity for the Si atom when the pure silica fine particles are measured by ESCA.

When a plurality of external additive species are used, the coverage ratio X1 is determined for each of the external additives and the sum of these values is used as X1.

This coverage ratio X1 represents the proportion, of the toner particle surface, for the area that is actually covered by the external additive.

The theoretical coverage ratio X2 by the external additive, on the other hand, is calculated from the following formula (4) using, inter alia, the particle diameter of the external additive and the number of mass parts of the external additive per 100 mass parts of the toner particle. This represents the proportion for the area that can theoretically be covered, of the toner particle surface.

$$\text{theoretical coverage ratio } X2(\text{area }\%)=3^{1/2}/(2\pi)\times(dt/da)\times(\rho t/\rho a)\times C\times 100 \quad (4)$$

When a plurality of external additive species are used, the theoretical coverage ratio X2 is calculated for each external additive and the sum of these values is used as X2.

da: number-average particle diameter (D1) of the external additive dt: weight-average particle diameter (D4) of the toner ρa: true density of the external additive ρt: true density of the toner C: mass of external additive/mass of toner (=number of parts of addition (mass parts) of external additive per 100 mass parts of the toner particle/(number of parts of addition (mass parts) of external additive per 100 mass parts of the toner particle+100 (mass parts))

When the amount of addition of the external additive is unclear, the amount of external additive addition is calculated based on the measurement method in "Content of the External Additive in the Toner" described below and this is used as "C". The value obtained based on the method for measuring the number-average primary particle diameter (D1) of the external additive based on observation of the toner particle surface, see below, is used for the number-average particle diameter (D1) of the external additive. However, when calculation by surface observation is problematic, for example, in the case of use of a plurality of external additive species, the preliminarily measured number-average particle diameter for each external additive may be used.

The physical meaning of the spreading index given by the preceding formula (1) is discussed in the following.

The spreading index represents the divergence between the measured coverage ratio X1 and the theoretical coverage ratio X2. The degree of this divergence is thought to represent the abundance of external additive stacked in, e.g., two or three layers in the perpendicular direction from the toner particle surface. The spreading index is ideally 1: this is the case in which the coverage ratio X1 agrees with the theoretical coverage ratio X2 and represents the condition in which external additive stacked in two or more layers is completely absent.

When, on the other hand, the external additive is present on the toner surface as aggregates, a divergence is produced between the measured coverage ratio and the theoretical coverage ratio and the spreading index is reduced. Thus, the spreading index is an alternative manner of representing the amount of external additive present as aggregates.

The spreading index preferably is in the range given by the preceding formula (2). This indicates, i.e., that preferably the spreading index takes on at least a certain prescribed value.

A larger spreading index indicates that, of the external additive on the toner particle surface, the amount present as aggregates is lower and the amount present as primary particles is greater. When the external additive is present as primary particles, the external additive can be attached in a more uniform state to the toner particle surface. The production of starting streaks in high-temperature, high-humidity environments can be suppressed as a result.

The boundary line for the spreading index is a function, in the coverage ratio X1 range from 50 area % to 85 area %, in which the coverage ratio X1 is the variable.

Figure 7:
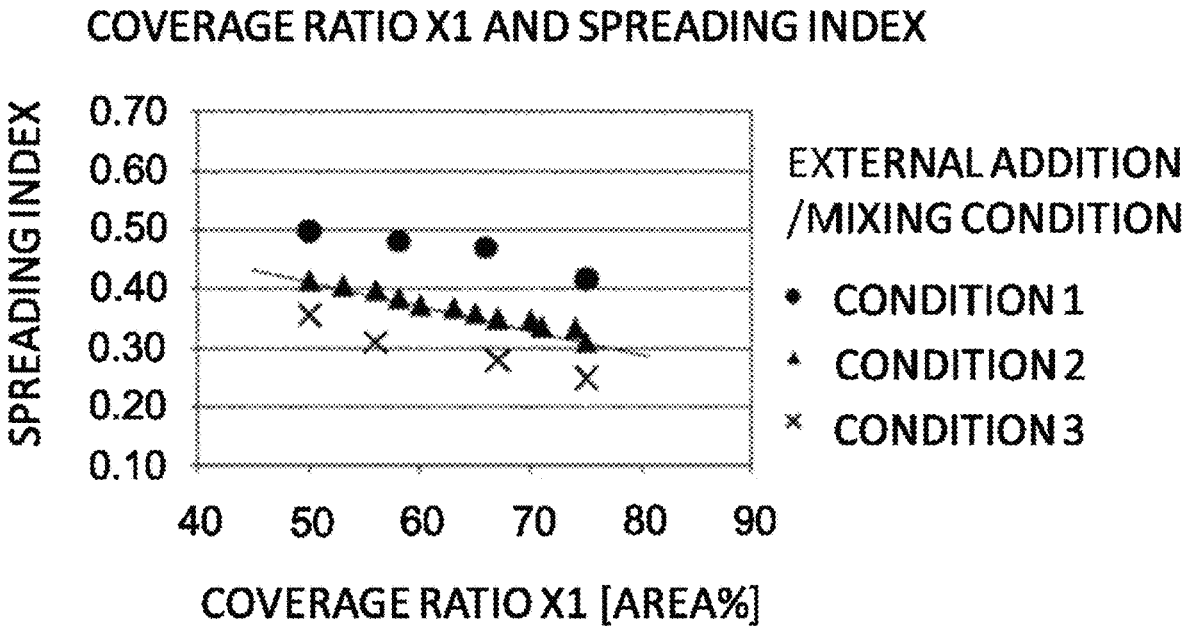
FIG. 7 is a diagram that shows the boundary line for the spreading index.

This function was determined as follows: using three external addition mixing conditions, toners were produced in which the coverage ratio X1 was freely varied by changing the amount of addition of the external additive, and a graph (FIG. 7) was constructed by plotting the relationship between the coverage ratio X1 and the spreading index. Using a cleaning blade according to the present disclosure, the toners plotted in this graph were submitted to evaluation of the cleaning performance during durability testing and evaluation of the starting streaking in a high-temperature, high-humidity environment. It was found as a result that, using the cleaning blade according to the present disclosure, for the toners that plotted into the region that satisfies formula (2) the production of starting streaks in a high-temperature, high-humidity environment can be inhibited and a stable cleaning performance is obtained even during durability testing.

The present inventors hypothesize the following as to the reasons for the dependence of the spreading index on the coverage ratio X1. In order to suppress the generation of starting streaks, it is more favorable that the amount of external additive present as secondary particles be smaller, but the influence of the coverage ratio X1 is also not insignificant. The suppressing effect on starting streaks gradually improves as the coverage ratio X1 increases, and as a consequence the permissible amount for the amount of external additive present as secondary particles increases. The spreading index boundary line is thus thought to be a function with the coverage ratio X1 as the variable.

That is, there is a correlation between the coverage ratio X1 and the spreading index, and the spreading index is preferably controlled depending on the coverage ratio X1.

The theoretical coverage ratio X2 is preferably 80 area % to 350 area % and is more preferably 100 area % to 200 area %. In addition, the spreading index is specifically preferably 0.51 to 0.56. In addition, the value of $-0.0042 \times X1+0.60$ is preferably 0.25 to 0.35.

The immobilization percentage F by the external additive on the toner particle is preferably at least 75%. Within this range, detachment of the external additive from the toner particle surface is suppressed when the toner between the cleaning blade and photosensitive member is subjected to force, and the generation of starting streaks caused by toner fusion to the photosensitive member can then be further restrained. The immobilization percentage F is more preferably at least 80%. The upper limit on the immobilization percentage F is not particularly limited, but, for example, is less than or equal to 100%.

The external additive preferably contains a hydrotalcite compound.

The incorporation of a hydrotalcite compound in the external additive provides an even greater suppression of detachment of the other external additive from the toner particle surface and can thus provide a further suppression of the occurrence of starting streaks. This effect is obtained regardless of the type of external additive and charging performance of the toner, but is conspicuously obtained when the external additive also contains silica fine particles and when the toner is a negative-charging toner.

The present inventors believe as follows with regard to the reason for this. In the case of a negative-charging toner, a hydrotalcite compound frequently takes on a positive polarity in comparison to the toner particle or silica fine particle and exercises an adhesive force on both the toner particle and silica fine particle. It is thought that as a result the co-presence of a hydrotalcite compound impedes detachment of silica fine particles from the toner particle.

The external additive preferably contains silica fine particles. Silica fine particles obtained by a dry method, such as fumed silica, may be used, or silica fine particles obtained by a wet method, such as a sol-gel method, may also be used. The use of silica particles obtained by a dry method is preferred from the standpoint of the charging performance.

The silica fine particles may be subjected to a surface treatment with the goal of imparting hydrophobicity and flowability. The hydrophobing method can be exemplified by methods in which a chemical treatment is carried out using an organosilicon compound that reacts with silica fine particles or that physically adsorbs to silica fine particles. In a preferred method, silica produced by a vapor-phase oxidation of a silicon halide compound is treated with an organosilicon compound. This organosilicon compound can be exemplified by the following:

hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, and benzyldimethylchlorosilane, and bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, and triorganosilyl acrylate.

Additional examples are vinyldimethylacetoxysilane, dimethylethoxysilane, dimethyldimethoxysilane, diphenyldiethoxysilane, and 1-hexamethyldisiloxane.

Additional examples are 1,3-divinyltetramethyldisiloxane, 1,3-diphenyltetramethyldisiloxane, and dimethylpolysiloxanes that have 2 to 12 siloxane units per molecule and that have one hydroxyl group on the Si in each of the terminal units.

A single one of the preceding may be used or a mixture of two or more may be used.

A silicone oil may be used for the surface treatment of the silica fine particles. That is, the silica fine particles may be silicone oil-treated silica fine particles. The silicone oil used for the surface treatment of the silica fine particles can be exemplified by dimethylsilicone oil, methylphenylsilicone oil, α-methylstyrene-modified silicone oil, chlorophenylsilicone oil, and fluorine-modified silicone oil. Silicone oils having a viscosity at 25° C. of from 30 $mm^2/s$ to 1,000 $mm^2/s$ are preferred.

Methods for treating the surface of silica fine particles using silicone oil can be exemplified by the following methods:

methods in which the silicone oil is directly mixed, using a mixer such as a Henschel mixer (product name), with silica fine particles that have been treated with a silane coupling agent;

methods in which the silicone oil is sprayed on silica fine particles functioning as a base; and methods in which the silicone oil is dissolved or dispersed in a suitable solvent, the silica fine particles are added with mixing, and the solvent is thereafter removed.

The coating on the surface of silicone oil-treated silica fine particles is more preferably stabilized by heating the silica, after its treatment with the silicone oil, to a temperature of at least 200° C. (more preferably at least 250° C.) in an inert gas.

The silane coupling agent is not particularly limited, and a preferred example is hexamethyldisilazane (HMDS).

The toner may contain additional external additives in order to enhance toner performance. This additional external additive may include known inorganic fine particles, known organic fine particles, and known organic-inorganic composite fine particles constituted of an inorganic material and an organic material. Alumina fine particles, titania fine particles, and their composite oxide fine particles are examples of inorganic fine particles other than silica fine particles and hydrotalcite compounds.

The content of the external additive is preferably from 0.05 mass parts to 5.0 mass parts per 100 mass parts of the toner particle. In addition, the proportion in the external additive of non-hydrotalcite-compound external additive (for example, silica fine particles) with reference to the hydrotalcite compound is preferably 10 mass % to 20 mass %.

A preferred method for adding an external additive to a toner particle will be described. A known mixing/processing apparatus can be used as the mixing/processing apparatus for the external addition/mixing of the external additive, but the apparatus as shown in FIG. 8 is preferred from the standpoint of enabling facile control of the coverage ratio X1 or the spreading index.

Figure 8:
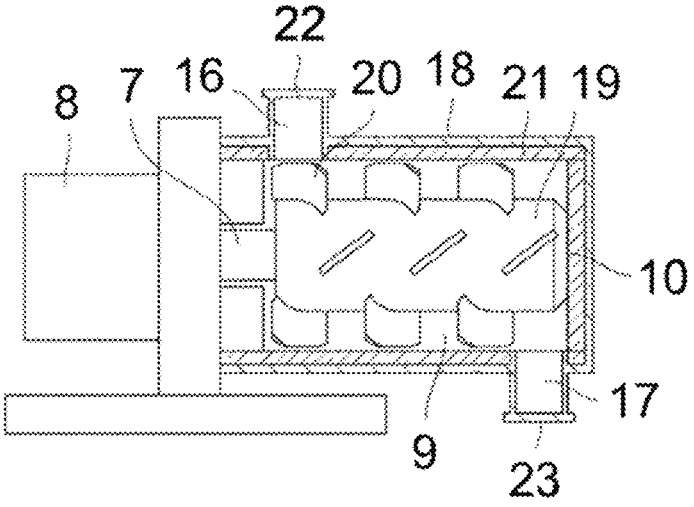
FIG. 8 is a schematic diagram that shows an example of a mixing/processing apparatus.

FIG. 8 is a schematic diagram that shows an example of a mixing/processing apparatus that can be used in the external addition/mixing of an external additive.

This mixing/processing apparatus has a structure that applies shear to the toner particle and external additive in a narrow clearance zone, and as a consequence can bring about the attachment of the external additive to the toner particle surface while breaking up the external additive from secondary particles to primary particles.

Moreover, the coverage ratio X1 and the spreading index are readily controlled into the ranges required in the present disclosure since, as described below, the toner particle and external additive are readily circulated in the axial direction of the rotor and a uniform and thorough mixing is facilitated prior to the progress of attachment.

Figure 9:
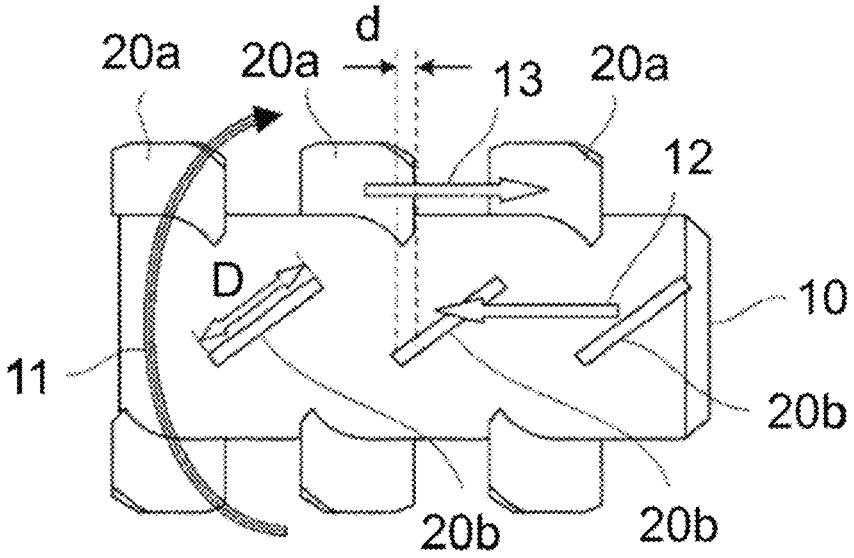
FIG. 9 is a schematic diagram that shows an example of the structure of a stirring member.

FIG. 9, on the other hand, is a schematic diagram that shows an example of the structure of a stirring member that is used in this mixing/processing apparatus. An external addition/mixing process for the external additive is described in the following using FIG. 8 and FIG. 9.

The mixing/processing apparatus that carries out external addition/mixing of the external additive has a rotor 19, on the surface of which at least a plurality of stirring members 20 are disposed; a drive member 8, which drives the rotation of the rotor; and a main casing 18, which is disposed to have a gap with the stirring member 20.

The gap (clearance) between the inner circumference of the main casing 18 and the stirring members 20*a*, 20*b* can be kept constant and very small in order to apply shear uniformly to the toner particles and facilitate attachment of the external additive to the toner particle surface while breaking the external additive secondary particles down into primary particles.

The diameter of the inner circumference of the main casing 18 in this apparatus can be not more than twice the diameter of the outer circumference of the rotor 19. In the example shown in FIG. 8, the diameter of the inner circumference of the main casing 18 is 1.7-times the diameter of the outer circumference of the rotor 19 (the trunk diameter provided by subtracting the stirring member 20 from the rotor 19). When the diameter of the inner circumference of the main casing 18 is not more than twice the diameter of the outer circumference of the rotor 19, an impact force is then satisfactorily applied to the external additive having the form of secondary particles because the processing space in which forces act on the toner particle is suitably limited.

In addition, the aforementioned clearance can be adjusted in conformity to the size of the main casing. From the standpoint of achieving a satisfactory application of shear to the external additive, the clearance preferably is made approximately from 1% to 5% of the diameter of the inner circumference of the main casing 18. Specifically, when the diameter of the inner circumference of the main casing 18 is approximately 130 mm, the clearance is preferably made approximately from 2 mm to 5 mm; when the diameter of the inner circumference of the main casing 18 is approximately 800 mm, the clearance is preferably made approximately from 10 mm to 30 mm.

The external addition/mixing process for the external additive preferably implements, using the mixing/processing apparatus shown in FIG. 8, a process of mixing and externally adding the external additive with/to the toner particle surface by rotating the rotor 19 with the drive member 8 and thereby stirring and mixing the toner particle and external additive that have been introduced into the mixing/processing apparatus.

As shown in FIG. 9, at least a portion of the plurality of stirring members 20 is formed as a transport stirring member 20*a* for transporting the toner particle and external additive in one direction along the axial direction of the rotor 19 accompanying the rotation of the rotor 19. In addition, at least a portion of the plurality of stirring members 20*a*, 20*b* is formed as a return stirring member 20*b* for returning the toner particle and external additive in the other direction along the axial direction of the rotor accompanying the rotation of the rotor 19. Here, when the starting material inlet port 22 and the product discharge port 23 are disposed at the two ends of the main casing 18, as in FIG. 8, the direction toward the product discharge port 23 from the starting material inlet port 22 (the direction to the right in FIG. 8) is the "forward direction".

That is, as shown in FIG. 9, the face of the transport stirring member 20*a* is tilted so as to transport the toner particle in the transport direction (13). On the other hand, the face of the stirring member 20*b* is tilted so as to transport the toner particle and external additive in the back direction (12).

By doing this, the process of mixing and external addition of the external additive to the toner particle surface can be carried out while repeatedly performing transport in the "forward direction" (13) and transport in the "back direction" (12). In addition, with regard to the stirring members 20*a* and 20*b*, a plurality of members disposed at intervals in the circumferential direction of the rotor 19 form a set. In the example shown in FIG. 9, two members at an interval of 180° with each other form a set of the stirring members 20*a*, 20*b* on the rotor 19, but a larger number of members may form a set, such as three at an interval of 120° or four at an interval of 90°.

In the example shown in FIG. 9, a total of twelve stirring members 20*a* and 20*b* are formed at an equal interval.

Furthermore, D in FIG. 9 indicates the width of a stirring member and d indicates the distance that represents the overlapping portion of a stirring member. From the standpoint of bringing about an efficient transport of the toner particle and external additive in the forward direction and back direction, D in FIG. 9 is preferably a width that is approximately from 20% to 30% of the length of the rotor 19. FIG. 9 shows an example in which D is 23%. Furthermore, when, for stirring members 20*a* and 20*b*, an extension line is drawn in the perpendicular direction from the location of the end of the stirring member 20*a*, an overlapping portion d of the stirring member 20*a* with the stirring member 20*b* is preferably present to a certain degree.

This enables and supports the efficient application of shear to the external additive that has taken the form of secondary particles. d being from 10% to 30% of D is preferred from the standpoint of the application of shear.

In addition to the shape as shown in FIG. 9, the blade shape may be—insofar as the toner particle can be transported in the forward direction and back direction and the clearance can be maintained—a shape having a curved surface or a paddle structure in which a distal blade element is connected to the rotor 19 by a rod-shaped arm.

A more detailed description is provided in the following with reference to the schematic diagrams of the apparatus shown in FIG. 8 and FIG. 9. The apparatus shown in FIG. 8 has a rotor 19, which has at least a plurality of stirring members 20*a*, 20*b* disposed on its surface; the drive member 8 that drives the rotation of the rotor 19; a main casing 18, which is disposed forming a gap with the stirring members 20*a*, 20*b*; and a jacket 21, in which a heat transfer medium can flow and which resides on the inside of the main casing 18 and at the end surface 10 of the rotor.

The apparatus shown in FIG. 8 also has a starting material inlet port 22, which is formed in the upper part of the main casing 18 for the purpose of introducing the toner particle and external additive, and has a product discharge port 23, which is formed in the lower part of the main casing 18 in order to discharge to the outside of the main casing 18 the toner that has been subjected to the external addition and mixing process.

In addition, the apparatus shown in FIG. 8 has a starting material inlet port inner piece 16 inserted in the starting material inlet port 22 and has a product discharge port inner piece 17 inserted in the product discharge port 23.

The starting material inlet port inner piece 16 is first removed from the starting material inlet port 22 and the toner particles are introduced into the processing space 9 from the starting material inlet port 22. The external additive is then introduced into the processing space 9 from the starting material inlet port 22 and the starting material inlet port inner piece 16 is inserted. The rotor 19 is then rotated by the drive member 8 (11 represents the direction of rotation), and the material to be processed, which has been introduced as described above, is subjected to an external addition and mixing process while being stirred and mixed by the plurality of stirring members 20*a*, 20*b* disposed on the surface of the rotor 19.

The sequence of introduction may be introduction of the external additive from the starting material inlet port 22 first, followed by toner particle introduction from the starting material inlet port 22. In addition, the toner particle and external additive may be preliminarily mixed using a mixer such as a Henschel mixer (product name) followed by introduction of the mixture through the starting material inlet port 22 of the apparatus shown in FIG. 8.

More specifically with regard to the conditions for the external addition and mixing process, the power from the drive member 8 is preferably controlled to from 0.2 W/g to 2.0 W/g from the standpoint of obtaining the coverage ratio X1 and spreading index specified by the present disclosure. The power from the drive member 8 is more preferably controlled to from 0.6 W/g to 1.6 W/g.

A high coverage ratio X1 and a high spreading index tend to be easily achieved when the power is at least 0.2 W/g. Suppression of excessive embedding of the external additive tends to be possible, while raising the spreading index, at less than or equal to 2.0 W/g.

The processing time is not particularly limited, but is preferably from 3 minutes to 10 minutes. A high coverage ratio X1 and a high spreading index tend to be achieved when the processing time is at least 3 minutes. The rotation rate of the stirring members during external addition and mixing is not particularly limited, but, for an apparatus in which the volume of the processing space 9 in the apparatus shown in FIG. 9 is $2.0\times10^{-3}$ $m^3$, the stirring member rotation rate, for the shape of the stirring members 20*a*, 20*b* shown in FIG. 9, is preferably from 800 rpm to 3,000 rpm. The coverage ratio X1 and spreading index specified by the present disclosure are readily obtained at from 800 rpm to 3,000 rpm.

In a particularly preferred processing method, a pre-mixing step is implemented prior to the external addition/mixing processing operation. The insertion of a pre-mixing step, by supporting a highly uniform dispersion of the external additive on the toner particle surface, facilitates achieving a high coverage ratio X1 and also facilitates achieving a high spreading index.

More specifically, a drive power from the drive member 8 of from 0.06 W/g to 0.20 W/g and a processing time of from 0.5 minutes to 1.5 minutes are preferred for the pre-mixing processing conditions. A satisfactorily uniform mixing for pre-mixing is readily provided when a load power of at least 0.06 W/g or a processing time of at least 0.5 minutes is used for the pre-mixing processing conditions. On the other hand, the external additive is attached to the toner particle surface, in addition to achieving a satisfactorily uniform mixing, when a load power of not more than 0.20 W/g or a processing time of not more than 1.5 minutes is used for the pre-mixing processing conditions.

With regard to the rotation rate of the stirring members during the pre-mixing process, for an apparatus in which the volume of the processing space 9 in the apparatus shown in FIG. 8 is $2.0\times10^{-3}$ $m^3$, the stirring member rotation rate, for the shape of the stirring members 20*a*, 20*b* shown in FIG. 9, is preferably from 50 rpm to 500 rpm. The coverage ratio X1 and spreading index specified by the present disclosure are readily obtained at from 50 rpm to 500 rpm.

After the completion of the external addition and mixing process, the product discharge port inner piece 17 in the product discharge port 23 is removed and the rotor 19 is rotated by the drive member 8 and the toner is discharged from the product discharge port 23. The resulting toner can optionally be subjected to separation of the coarse particles and so forth using a sieve, e.g., a circular vibrating screen, to yield a toner.

Toner particle production methods will now be described. A known means can be used for the toner particle production method; for example, a kneading pulverization method or a wet production method may be used. The use of a wet production method is preferred from the standpoint of shape controllability and achieving a more uniform particle diameter. Wet production methods can be exemplified by the suspension polymerization method, the dissolution suspension method, the emulsion polymerization and aggregation method, and the emulsion aggregation method, and the use of the emulsion aggregation method is preferred.

An example of a toner particle production method using the emulsion aggregation method will be described. In the emulsion aggregation method, fine particles of a binder resin and optionally starting materials such as a colorant and so forth are dispersed and mixed in an aqueous medium that contains a dispersion stabilizer. A surfactant may be added to the aqueous medium. This is followed by the addition of an aggregating agent to form associated particles by inducing aggregation to a desired particle diameter, and fusion within the associated particles is carried out afterwards or at the same time as aggregation. Toner particle formation may optionally proceed by carrying out heat-mediated control of the shape. The binder resin fine particles here may also take the form of composite particles formed of a plurality of layers comprising two or more layers that contain resins with different compositions. For example, production can be carried out by, e.g., emulsion polymerization, miniemulsion polymerization, phase inversion emulsification, and so forth, or production can be carried out by combining several methods.

When an internal additive is to be incorporated in the toner particle, the internal additive may be incorporated in the resin fine particles, or a dispersion may be separately prepared of internal additive fine particles that contain the internal additive and aggregation of these internal additive fine particles may be carried out during aggregation of the resin fine particles. A toner particle constructed of layers having different compositions may also be produced by carrying out aggregation with the addition at different times during aggregation of resin fine particles having different compositions.

The following, for example, can be used as the dispersion stabilizer. Inorganic dispersion stabilizers can be exemplified by tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina.

Organic dispersion stabilizers can be exemplified by polyvinyl alcohol, gelatin, methyl cellulose, methyl hydroxypropyl cellulose, ethyl cellulose, the sodium salt of carboxymethyl cellulose, and starch.

A known cationic surfactant, anionic surfactant, or nonionic surfactant can be used as the surfactant.

The cationic surfactant can be specifically exemplified by dodecylammonium bromide, dodecyltrimethylammonium bromide, dodecylpyridinium chloride, dodecylpyridinium bromide, and hexadecyltrimethylammonium bromide.

The nonionic surfactant can be specifically exemplified by dodecyl polyoxyethylene ether, hexadecyl polyoxyethylene ether, nonylphenyl polyoxyethylene ether, lauryl polyoxyethylene ether, sorbitan monooleate polyoxyethylene ether, stearylphenyl polyoxyethylene ether, and monodecanoylsucrose.

The anionic surfactant can be specifically exemplified by aliphatic soaps such as sodium stearate and sodium laurate as well as by sodium lauryl sulfate, sodium dodecylbenzenesulfonate, and sodium polyoxyethylene(2) lauryl ether sulfate.

The binder resin constituting the toner particle will now be described. Vinyl-based resins and polyester resins can be given as preferred examples of the binder resin. The following resins and polymers can be given as examples of vinyl-based resins, polyester resins and other binder resins. Homopolymers of styrene and substituted products thereof, such as polystyrene and polyvinyltoluene; styrene-based copolymers such as styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers and styrene-maleic acid ester copolymers; poly(methyl methacrylate), poly(butyl methacrylate), poly (vinyl acetate), polyethylene, polypropylene, poly(vinyl butyral), silicone resins, polyamide resins, epoxy resins, polyacrylic resins, rosins, modified rosins, terpene resins, phenolic resins, aliphatic and alicyclic hydrocarbon resins, and aromatic petroleum resins. These binder resins can be used in isolation, or a mixture thereof.

The polymerizable monomer that can be used to produce the vinyl resin can be exemplified by styrenic monomers such as α-methylstyrene and styrene; acrylate esters such as methyl acrylate and butyl acrylate; methacrylate esters such as methyl methacrylate, 2-hydroxyethyl methacrylate, t-butyl methacrylate, and 2-ethylhexyl methacrylate; unsaturated carboxylic acids such as acrylic acid and methacrylic acid; unsaturated dicarboxylic acids such as maleic acid; unsaturated dicarboxylic acid anhydrides such as maleic anhydride; nitrile-type vinyl monomers such as acrylonitrile; halogenated vinyl monomers such as vinyl chloride; and nitro-type vinyl monomers such as nitrostyrene.

The binder resin preferably contains the carboxy group and preferably is a resin produced using a carboxy group-containing polymerizable monomer. Examples of a polymerizable monomers containing carboxyl group include vinyl-based carboxylic acids such as acrylic acid, methacrylic acid, α-ethylacrylic acid and crotonic acid; unsaturated dicarboxylic acids such as fumaric acid, maleic acid, citraconic acid and itaconic acid; and monoester derivatives of unsaturated dicarboxylic acids, such as monoacryloyloxyethyl ester succinate, monomethacryloyloxyethyl ester succinate, monoacryloyloxyethyl ester phthalate and monomethacryloyloxyethyl ester phthalate.

Resins obtained through condensation polymerization of carboxylic acid components and alcohol components listed below can be used as the polyester resin. Examples of the carboxylic acid component include terephthalic acid, isophthalic acid, phthalic acid, fumaric acid, maleic acid, cyclohexanedicarboxylic acid and trimellitic acid. Examples of the alcohol component include bisphenol A, hydrogenated bisphenols, ethylene oxide adducts of bisphenol A, propylene oxide adducts of bisphenol A, glycerin, trimethylolpropane and pentaerythritol. In addition, the polyester resin may be a polyester resin containing urea group. As a polyester resin, it is preferable not to cap the carboxyl groups at a terminal or the like.

A crosslinking agent may be added when the polymerizable monomer is polymerized in order to control the molecular weight of the binder resin. Examples of crosslinking agents include ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, divinylbenzene, bis(4-acryloxypolyethoxyphenyl)propane, ethylene glycol diacrylate, 1,3-butylene glycol diacrylate, 1,4-butane diol diacrylate, 1,5-pentane diol diacrylate, 1,6-hexane diol diacrylate, neopentyl glycol diacrylate, diethylene glycol diacrylate, triethylene glycol diacrylate, tetraethylene glycol diacrylate, polyethylene glycol #200, #400 and #600 diacrylates, dipropylene glycol diacrylate, polypropylene glycol diacrylate, polyester type diacrylates (MANDA available from Nippon Kayaku Co., Ltd.) and compounds obtained by replacing the acrylates mentioned above with methacrylates. The added amount of the crosslinking agent is preferably from 0.001 parts by mass to 15.000 parts by mass relative to 100 parts by mass of polymerizable monomer.

The toner particle preferably contains a release agent. This release agent is more preferably an ester wax. In addition, the melting point of the release agent is also more preferably from 60° C. to 90° C. The toner particle even more preferably contains an ester wax having a melting point from 60° C. to 90° C. Such waxes exhibit an excellent compatibility with the binder resin and due to this a plasticizing effect is readily obtained.

The ester wax can be exemplified by waxes in which the major component is fatty acid ester, such as carnauba wax and montanic acid ester waxes; waxes provided by the partial or complete deacidification of the acid component from fatty acid esters, such as deacidified carnauba wax; hydroxyl group-containing methyl ester compounds obtained by, e.g., the hydrogenation of plant oils and fats; saturated fatty acid monoesters, e.g., stearyl stearate and behenyl behenate; diesters between a saturated aliphatic dicarboxylic acid and a saturated aliphatic alcohol, e.g., dibehenyl sebacate, distearyl dodecanedioate, and distearyl octadecanedioate; and diesters between a saturated aliphatic diol and a saturated aliphatic monocarboxylic acid, e.g., nonanediol dibehenate and dodecanediol distearate.

Among the ester waxes, a difunctional ester wax (diester), which has two ester bonds in the molecular structure, may be incorporated. A difunctional ester wax is an ester of a dihydric alcohol and an aliphatic monocarboxylic acid, or an ester of a dihydric carboxylic acid and an aliphatic monoalcohol.

Specific examples of aliphatic monocarboxylic acids include myristic acid, palmitic acid, stearic acid, arachidic acid, behenic acid, lignoceric acid, cerotic acid, montanic acid, melissic acid, oleic acid, vaccenic acid, linoleic acid and linolenic acid. Specific examples of aliphatic monoalcohols include myristyl alcohol, cetanol, stearyl alcohol, arachidyl alcohol, behenyl alcohol, tetracosanol, hexacosanol, octacosanol and triacontanol.

Specific examples of dihydric carboxylic acids include butanedioic acid (succinic acid), pentanedioic acid (glutaric acid), hexanedioic acid (adipic acid), heptanedioic acid (pimelic acid), octanedioic acid (suberic acid), nonanedioic acid (azelaic acid), decanedioic acid (sebacic acid), dodecanedioic acid, tridecanedioic acid, tetradecanedioic acid, hexadecanedioic acid, octadecanedioic acid, eicosanedioic acid, phthalic acid, isophthalic acid and terephthalic acid. Specific examples of dihydric alcohols include ethylene glycol, propylene glycol, 1,3-propane diol, 1,4-butane diol, 1,5-pentane diol, 1,6-hexane diol, 1,10-decane diol, 1,12-dodecane diol, 1,14-tetradecane diol, 1,16-hexadecane diol, 1,18-octadecane diol, 1,20-eicosane diol, 1,30-triacontane diol, diethylene glycol, dipropylene glycol, 2,2,4-trimethyl-1,3-pentane diol, neopentyl glycol, 1,4-cyclohexane dimethanol, spiroglycol, 1,4-phenylene glycol, bisphenol A and hydrogenated bisphenol A.

Other usable release agents can be exemplified by petroleum-based waxes such as paraffin waxes, microcrystalline waxes, and petrolatum, and derivatives thereof; montan wax and derivatives thereof; hydrocarbon waxes produced by the Fischer-Tropsch method, and derivatives thereof; polyolefin waxes such as polyethylene and polypropylene, and derivatives thereof; natural waxes such as carnauba wax and candelilla wax, and derivatives thereof; and higher aliphatic alcohols and fatty acids such as stearic acid and palmitic acid, and their compounds.

The content of the release agent is preferably from 5.0 mass parts to 20.0 mass parts per 100.0 mass parts of the binder resin.

The toner may include a colorant. The colorant is not particularly limited, and known colorants can be used.

Examples of yellow pigments include yellow iron oxide and condensed azo compounds such as Navels Yellow, Naphthol Yellow S, Hansa Yellow G, Hansa Yellow 10G, Benzidine Yellow G, Benzidine Yellow GR, Quinoline Yellow Lake, Permanent Yellow NCG, Tartrazine Lake, and the like, isoindolinone compounds, anthraquinone compounds, azo metal complexes, methine compounds, and allylamide compounds. Specific examples are presented hereinbelow.

C. I. Pigment Yellow 12, 13, 14, 15, 17, 62, 74, 83, 93, 94, 95, 109, 110, 111, 128, 129, 147, 155, 168, 180.

Examples of red pigments include Indian Red, condensation azo compounds such as Permanent Red 4R, Lithol Red, Pyrazolone Red, Watching Red calcium salt, Lake Red C, Lake Red D, Brilliant Carmine 6B, Brilliant Carmine 3B, Eosin Lake, Rhodamine Lake B, Alizarin Lake and the like, diketopyrrolopyrrole compounds, anthraquinone compounds, quinacridone compounds, basic dye lake compounds, naphthol compounds, benzimidazolone compounds, thioindigo compounds, perylene compounds. Specific examples are presented hereinbelow.

C. I. Pigment Red 2, 3, 5, 6, 7, 23, 48:2, 48:3, 48:4, 57:1, 81:1, 122, 144, 146, 166, 169, 177, 184, 185, 202, 206, 220, 221, 254.

Examples of blue pigments include copper phthalocyanine compounds and derivatives thereof such as Alkali Blue Lake, Victoria Blue Lake, Phthalocyanine Blue, metal-free Phthalocyanine Blue, partial Phthalocyanine Blue chloride, Fast Sky Blue, Indathrene Blue BG and the like, anthraquinone compounds, basic dye lake compound and the like. Specific examples are presented hereinbelow.

C. I. Pigment Blue 1, 7, 15, 15:1, 15:2, 15:3, 15:4, 60, 62, 66.

Examples of black pigments include carbon black and aniline black.

A single one of these colorants may be used by itself or a combination of two or more may be used, and these colorants may also be used in solid solution form. The colorant content is preferably from 3.0 mass parts to 15.0 mass parts per 100.0 mass parts of the binder resin.

The toner particle may contain a charge control agent. A known charge control agent may be used as this charge control agent. A charge control agent which has a fast charging speed and can stably maintain a certain charge quantity is particularly preferred.

Examples of charge control agents that impart the toner particle with negative chargeability include the compounds listed below. Examples of organometallic compounds and chelate compounds include monoazo metal compounds, acetylacetone metal compounds, aromatic oxycarboxylic acids, aromatic dicarboxylic acids, and oxycarboxylic acid-based and dicarboxylic acid-based metal compounds. In addition, aromatic oxycarboxylic acids, aromatic monocarboxylic acids and polycarboxylic acids and its metal salts and anhydrides, phenol derivatives such as esters and bisphenols and the like, are also included. Further examples include urea derivatives, metal-containing salicylic acid-based compounds, metal-containing naphthoic acid-based compounds, boron compounds, quaternary ammonium salts and calixarene.

Meanwhile, examples of charge control agents that impart the toner particle with positive chargeability include the compounds listed below. Products modified by means of nigrosine and fatty acid metal salts; guanidine compounds; imidazole compounds; quaternary ammonium salts such as tributylbenzyl ammonium-1-hydroxy-4-naphthosulfonic acid salts, tetrabutyl ammonium tetrafluoroborate, and analogs thereof; onium salts such as phosphonium salts, and lake pigments thereof; triphenylmethane dyes and Lake pigments thereof (examples of laking agents include phosphotungstic acid, phosphomolybdic acid, phosphotungstic-molybdic acid, tannic acid, lauric acid, gallic acid, ferricyanic acid and ferrocyanic compounds); metal salts of higher fatty acids; and resin-based charge control agents.

A single one of these charge control agents may be incorporated or a combination of two or more may be incorporated. The amount of charge control agent addition is preferably from 0.01 parts by mass to 10.0 parts by mass per 100 parts by mass of the binder resin.

Methods for measuring the various properties of the cleaning blade according to the present disclosure are described in the following.

Method for Measuring the Elastic Modulus

The elastic modulus by SPM is measured using the method described in the following. An MFP-3D-Origin (Oxford Instruments Company) is used for the scanning probe microscope (SPM).

The following method is used to prepare the measurement sample. Using each of P1 to P9 as the geometric center, a 2 mm-square measurement sample with one edge parallel to the first line segment is cut out. Using a cryomicrotome (UC-6 (product name), Leica Microsystems) and using each of P1 to P9 as the geometric center, a polyurethane thin section with a thickness of 200 nm and a size of 100 μm×100 μm, and with one edge parallel to the first line segment, is then sectioned out at −150° C. from each of the measurement samples. Each of the obtained measurement samples is mounted on a smooth silicon wafer, and holding is carried out for 24 hours in an environment at room temperature 25° C. and a relative humidity of 50%.

The silicon wafer bearing the measurement sample is then set on the SPM stage and SPM observation is performed. The spring constant and impulse constant of the probe (product name: AC160, Olympus Corporation) are confirmed in advance to be the following using the thermal noise procedure provided with this SPM device.

spring constant: 30.22 nN/nm impulse constant: 82.59 nm/V

In addition, preliminary tuning of the probe is performed and the resonance frequency of the probe is determined.

resonance frequency of the probe: 285 kHz (1st order) and 1.60 MHz (high order)

The SPM measurement mode is AM-FM mode; the free amplitude of the probe is 3 V (1st order) and 25 mV (high order); and the set point amplitude is 2 V (1st order) and 25 mV (high order).

Scanning is carried out in a 70 μm×70 μm square field of observation using conditions of a scan rate of 1 Hz and a number of scan points of 256 for the vertical and 256 for the horizontal, and the height image and phase image are acquired simultaneously. With regard to the field of observation, each of P1 to P9 in the individual measurement samples is present in the center of the field of observation, and in addition a location is selected for which one edge is parallel to the first line segment.

The locations in the measurement sample for carrying out elastic modulus measurement by force curve measurement are then designated from the obtained height image and phase image. That is, a total of 630 points are designated: 70 points each on a 1 μm pitch (interval), centered on each of P1 to P9, on the first line segment. This is followed by measurement, one time each, of the force curve in contact mode at all of the points of the 630 points.

Force curve acquisition was carried out using the following conditions. In the force curve measurement, the piezo element (Z piezo) that is the probe drive source is controlled so return occurs when probe deflection due to probe tip contact with the sample surface becomes a constant value. The return point at this time is referred to as the trigger value, and indicates how much the voltage has increased from the deflection voltage at the start of the force curve when probe return occurs. In this measurement, the force curve is measured using a trigger value of 0.2 V.

Other force curve measurement conditions are: 500 nm=distance from the tip position of the probe in the standby condition to probe return at the trigger value; scan rate=1 Hz (speed of one probe reciprocation).

This is followed by fitting based on Hertz theory for each obtained force curve and calculation of the elastic modulus. The elastic modulus (Young's modulus) based on Hertz theory is calculated using the following formula (*1).

$$F=(4/3)E^{*}R^{1/2}d^{3/2} \quad \text{formula (*1)}$$

Here, F is the force applied to the sample by the probe at the point of probe return, E* is the complex elastic modulus, R is the radius of curvature (8 nm) of the probe tip, and d is the amount of deformation of the sample at the point of probe return.

In addition, d is calculated using the following formula (*2).

$$d=\Delta z-D. \quad \text{formula (*2)}$$

Δz is the amount of displacement of the piezo element from when the probe tip has contacted the sample to return, and D is the amount of probe bending at the point of probe return.

D is calculated using the following formula (*3).

$$D=\alpha\cdot\Delta V_{deflection} \quad \text{formula (*3)}$$

In formula (*3), a is the impulse constant of the probe and $\Delta V_{deflection}$ represents the amount of change in the deflection voltage from the start of contact with the sample by the probe to the point of return.

In addition, F is calculated using the following formula (*4).

$$F=\kappa\cdot D \quad \text{formula (*4)}$$

κ is the spring constant of the probe.

Since $\Delta V_{deflection}$ and Δz are measured values, the E* in formula (*1) may be calculated from formulas (*1) to (*4). In addition, the elastic modulus (Young's modulus) Es to be determined can be calculated from the following formula (*5).

$$1/E^*=[(1-Vs^2)/Es]-[(1-Vi^2)/Ei] \quad \text{formula (*5)}$$

Vs: Poisson's ratio of the sample (fixed at 0.33 in this example)

Vi: Poisson's ratio of the probe tip (the value for silicon is used in this example)

Ei: Young's modulus of the probe tip (the value for silicon is used in this example)

The average value of the elastic modulus calculated from the force curves for the total of 630 points, i.e., 70 points, 9 locations, is used as the elastic modulus. The standard deviation was calculated from the elastic modulus values for the total of 630 points. The coefficient of variation is calculated from the average value and the standard deviation. The calculated values in the examples are given in Tables 1-1 and 1-2.

Method for Measuring the Martens Hardness

The Martens hardness is measured using the following method.

A hypothetical first line segment is drawn on the tip surface of the elastic member in parallel to the tip side edge at a distance of 10 μm from the tip side edge and having the same length as the tip side edge, and the length of this first line segment is designated as L. HM1 is the Martens hardness measured on the first line segment at the point that is (5/10)L from one end of the first line segment, i.e., the location of P5.

A hypothetical bisector is drawn of the angle made between the main surface and the tip surface in a cross section of the elastic member that is orthogonal to the tip side edge and the tip surface that contains P5, and HM2 is the Martens hardness of the elastic member measured at a location that is a distance of 500 μm from the tip side edge on the bisector (refer to FIG. 6). The numerical values of |HM1-HM2| measured in the examples are given in Tables 2-1 and 2-2.

microhardness meter: DUH-211S from Shimadzu Corporation measurement environment: 23±5° C.

measurement indenter: 115° triangular pyramidal indenter (115° ridge angle)

measurement mode: depth setting test depth setting: 2 μm loading rate: 0.03 mN/s holding time: 5 s calculation formula: Martens hardness=1000 F/26.43 $h^2$ [N/$mm^2$]

F: test force (mN), h: indention depth (μull)

The methods for measuring the various toner properties in the present disclosure are described in the following.

Method for Measuring the Number-Average Primary Particle Diameter (D1) of the External Additive The method for measuring the number-average primary particle diameter (D1) of the external additive from the toner involves calculation from the image of the external additive on the toner particle surface taken using an "S-4800" (product name, Hitachi, Ltd.) scanning electron microscope. The imaging conditions with the S-4800 are as follows.

(1) Specimen Preparation

An electroconductive paste is spread in a thin layer on the specimen stub (15 mm×6 mm aluminum specimen stub) and the toner is sprayed onto this. Blowing with air is additionally performed to remove excess toner from the specimen stub and carry out thorough drying. The specimen stub is set in the specimen holder and the specimen stub height is adjusted to 36 mm with the specimen height gauge.

(2) Setting the Conditions for Observation with the S-4800

Calculation of the number-average primary particle diameter of the external additive is carried out using the image obtained by backscattered electron image observation with the S-4800. The backscattered electron image provides less charge up of the external additive than with the secondary electron image, which enables measurement of the particle diameter of the external additive with good accuracy.

Liquid nitrogen is introduced to the brim of the anti-contamination trap attached to the S-4800 housing and standing for 30 minutes is carried out. The "PC-SEM" of the S-4800 is started and flashing is performed (the FE tip, which is the electron source, is cleaned). The acceleration voltage display area in the control panel on the screen is clicked and the [flashing] button is pressed to open the flashing execution dialog.

A flashing intensity of 2 is confirmed and execution is carried out. The emission current due to flashing is confirmed to be 20 μA to 40 μA. The specimen holder is inserted in the specimen chamber of the S-4800 housing. [home] is pressed on the control panel to transfer the specimen holder to the observation position.

The acceleration voltage display area is clicked to open the HV setting dialog and the acceleration voltage is set to [0.8 kV] and the emission current is set to [20 μA]. In the [base] tab of the operation panel, signal selection is set to [SE], [upper (U)] and [+BSE] are selected for the SE detector, and the instrument is placed in backscattered electron image observation mode by selecting [L. A. 100] in the selection box to the right of [+BSE].

Similarly, in the [base] tab of the operation panel, the probe current of the electron optical system condition block is set to [Normal]; the focus mode is set to [UHR]; and WD is set to [3.0 mm]. The [ON] button in the acceleration voltage display area of the control panel is pressed to apply the acceleration voltage.

(3) Calculation of the Number-Average Particle Diameter (D1) of the External Additive (the "Da" Used in Calculation of the Theoretical Coverage Ratio)

The magnification is set to 50,000 (50 k) by dragging within the magnification indicator area of the control panel. Turning the [COARSE] focus knob on the operation panel, adjustment of the aperture alignment is carried out where some degree of focus has been obtained. [Align] in the control panel is clicked and the alignment dialog is displayed and [beam] is selected. The displayed beam is migrated to the center of the concentric circles by turning the STIGMA/ALIGNMENT knobs (X, Y) on the operation panel.

[aperture] is then selected and the STIGMA/ALIGNMENT knobs (X, Y) are turned one at a time and adjustment is performed so as to stop the motion of the image or minimize the motion. The aperture dialog is closed and focus is performed with the autofocus. This operation is repeated an additional two times to achieve focus.

The particle diameter is then measured on 100 of the external additive on the toner particle surface and the average particle diameter is determined. Since external additive may also be present as aggregates, the maximum diameter of external additive that can be confirmed as primary particles is determined and the number-average primary particle diameter (D1) of the external additive is obtained by taking the arithmetic average of the obtained maximum diameters.

When multiple external additive species are used, elemental analysis is preliminarily carried out using an energy-dispersive X-ray analyzer (EDAX), and the number-average primary particle diameter of each external additive is determined after the species of the external additives on the toner surface have been established.

When calculation of the number-average particle diameter by surface observation is problematic, the preliminarily measured number-average particle diameter for each external additive may be employed. In this case, the pure external additive is observed with a transmission electron microscope, the long diameter of 100 particles is measured, and the number-average particle diameter is determined therefrom.

Method for Measuring the Immobilization Percentage of the External Additive

A sucrose concentrate is prepared by the addition of 160 g of sucrose (Kishida Chemical Co., Ltd.) to 100 mL of deionized water and dissolving while heating on a water bath. 31 g of this sucrose concentrate and 6 mL of Contaminon N (a 10 mass % aqueous solution of a neutral pH 7 detergent for cleaning precision measurement instrumentation, comprising a nonionic surfactant, anionic surfactant, and organic builder, Wako Pure Chemical Industries, Ltd.) are introduced into a centrifugal separation tube (50 mL volume) to prepare a dispersion. 1.0 g of the toner is added to this dispersion, and clumps of the toner are broken up using, for example, a spatula.

The centrifugal separation tube is shaken with a shaker for 20 minutes at 350 strokes per minute (spm). After shaking, the solution is transferred over to a glass tube (50 mL volume) for swing rotor service, and separation is performed with a centrifugal separator (H-9R, Kokusan Co., Ltd.) using conditions of 3,500 rpm and 30 minutes. Satisfactory separation of the toner from the aqueous solution is checked visually, and the toner separated into the uppermost layer is recovered with, for example, a spatula. The aqueous solution containing the recovered toner is filtered on a vacuum filter and then dried for at least 1 hour in a dryer. The dried product is crushed with a spatula and the amount of silicon is measured by X-ray fluorescence. The immobilization percentage (%) is calculated from the ratio for the amount of the measured element between the post-water-wash toner and the starting toner.

Measurement of the X-ray fluorescence of the particular element is based on JIS K 0119-1969 and specifically proceeds as follows.

An "Axios" wavelength-dispersive X-ray fluorescence analyzer (PANalytical B.V.) is used as the measurement instrumentation, and the "SuperQ ver. 4.0F" (PANalytical B.V.) software provided with the instrument is used in order to set the measurement conditions and analyze the measurement data. Rh is used for the X-ray tube anode; a vacuum is used for the measurement atmosphere; the measurement diameter (collimator mask diameter) is 10 mm; and the measurement time is 10 seconds. Detection is carried out with a proportional counter (PC) in the case of measurement of light elements, and with a scintillation counter (SC) in the case of measurement of heavy elements.

Approximately 1 g of the post-water-wash toner is introduced into a specialized aluminum compaction ring with a diameter of 10 mm and is smoothed over, and, using a "BRE-32" tablet compression molder (Maekawa Testing Machine Mfg. Co., Ltd.), a pellet is produced by molding to a thickness of approximately 2 mm by compression for 60 seconds at 20 MPa, and this pellet is used as the measurement sample. A pellet is also prepared using the same procedure and using the starting toner in place of the post-water-wash toner.

The measurement is performed using the conditions indicated above and the elements are identified based on the positions of the resulting X-ray peaks; their concentrations are calculated from the count rate (unit: cps), which is the number of X-ray photons per unit time.

The method for quantitation in the toner will be described using the example of silicon. 0.5 mass parts of silica ($SiO_2$) fine powder is added to 100 mass parts of the toner particle and thorough mixing is performed using a coffee mill. 2.0 mass parts and 5.0 mass parts of the silica fine powder are each likewise mixed with 100 mass parts of the toner particle, and these are used as samples for calibration curve construction.

For each of these samples, a pellet of the sample for calibration curve construction is fabricated proceeding as above using the tablet compression molder, and the count rate (unit: cps) is measured for the Si—Kα radiation observed at a diffraction angle (2θ)=109.08° using polyethylene terephthalate (PET) for the analyzer crystal. In this case, the acceleration voltage and current value for the X-ray generator are, respectively, 24 kV and 100 mA. A calibration curve in the form of a linear function is obtained by placing the obtained X-ray count rate on the vertical axis and the amount of $SiO_2$ addition to each calibration curve sample on the horizontal axis.

Then, using a pellet of the toner to be analyzed, its Si—Kα radiation count rate is measured. The content of the silicon in the toner is determined from the aforementioned calibration curve. The ratio of the amount of silicon for the toner treated with the aforementioned dispersion, to the amount of silicon for the starting toner calculated by the method described above, is determined and is used as the immobilization percentage (%).

The example of titanium will now be described. 0.5 mass parts of titanium oxide ($TiO_2$) fine powder is added to 100 mass parts of the toner particle and thorough mixing is performed using a coffee mill. 2.0 mass parts and 5.0 mass parts of the titanium oxide are each likewise mixed with 100 mass parts of the toner particle, and these are used as samples for calibration curve construction.

For each of these samples, a pellet of the sample for calibration curve construction is fabricated proceeding as above using the tablet compression molder, and the count rate (unit: cps) is measured for the Ti—Kα radiation observed at a diffraction angle (2θ)=109.08° using polyethylene terephthalate (PET) for the analyzer crystal. In this case, the acceleration voltage and current value for the X-ray generator are, respectively, 24 kV and 100 mA. A calibration curve in the form of a linear function is obtained by placing the obtained X-ray count rate on the vertical axis and the amount of $TiO_2$ addition to each calibration curve sample on the horizontal axis.

Then, using a pellet of the toner to be analyzed, its Ti—Kα radiation count rate is measured. The content of the titanium in the toner is determined from the aforementioned calibration curve. The ratio of the amount of titanium for the toner treated with the aforementioned dispersion, to the amount of titanium for the starting toner calculated by the method described above, is determined and is used as the immobilization percentage (%).

The weight-average particle diameter (D4) of the toner is calculated in the manner described below. A precision particle size distribution measuring apparatus based on a pore electric resistance method with a 100 μm aperture tube (a Coulter Counter Multisizer 3 (registered trademark) produced by Beckman Coulter, Inc.) and dedicated software for the measurement apparatus (Beckman Coulter Multisizer 3 Version 3.51 produced by Beckman Coulter, Inc.) for setting measurement conditions and analysis of measured data are used for measurement. The measurements are carried out using 25,000 effective measurement channels, and then measurement data is analyzed and calculated. A solution obtained by dissolving special grade sodium chloride in ion exchanged water at a concentration of approximately 1 mass %, such as "ISOTON II" (produced by Beckman Coulter), can be used as an aqueous electrolyte solution used in the measurements.

The dedicated software was set up in the following way before carrying out measurements and analysis. On the "Standard Operating Method (SOM) alteration" screen in the dedicated software, the total count number in control mode is set to 50,000 particles, the number of measurements is set to 1, and the Kd value is set to the value obtained by using "standard particle 10.0 μm" (Beckman Coulter). By pressing the "Threshold value/noise level measurement button", threshold values and noise levels are automatically set. In addition, the current is set to 1600 μA, the gain is set to 2, the electrolyte solution is set to ISOTON II, and the "Flush aperture tube after measurement" option is checked. On the "Conversion settings from pulse to particle diameter" screen in the dedicated software, the bin interval is set to logarithmic particle diameter, the particle diameter bin is set to 256 particle diameter bin, and the particle diameter range is set to from 2 μm to 60

The specific measurement method is as follows.

(1) 200 mL of the aqueous electrolyte solution is placed in a dedicated Multisizer 3 250 mL glass round bottomed beaker, the beaker is set on a sample stand, and a stirring rod is rotated anticlockwise at a rate of 24 rotations/second. By carrying out the "Aperture tube flush" function of the dedicated software, dirt and bubbles in the aperture tube are removed.

(2) Approximately 30 mL of the aqueous electrolyte solution is placed in a 100 mL glass flat bottomed beaker. Approximately 0.3 mL of a diluted liquid, which is obtained by diluting "Contaminon N" (a 10 mass % aqueous solution of a neutral detergent for cleaning precision measurement equipment, which has a pH of 7 and comprises a non-ionic surfactant, an anionic surfactant and an organic builder, available from Wako Pure Chemical Industries, Ltd.) approximately 3-fold in terms of mass with ion exchanged water, is added to the beaker as a dispersant.

(3) An ultrasonic wave disperser (Ultrasonic Dispersion System Tetra 150 produced by Nikkaki Bios Co., Ltd.) having an electrical output of 120 W, in which two oscillators having an oscillation frequency of 50 kHz are housed so that their phases are staggered by 180° is prepared. A prescribed amount of ion exchanged water is placed in a water bath in the ultrasonic dispersion system, and approximately 2 mL of Contaminon N is added to this water bath.

(4) The beaker mentioned in step (2) above is placed in a beaker-fixing hole in the ultrasonic wave disperser, and the ultrasonic wave disperser is activated. The height of the beaker is adjusted so that the resonant state of the liquid surface of the aqueous electrolyte solution in the beaker is at a maximum.

(5) While the aqueous electrolyte solution in the beaker mentioned in section (4) above is being irradiated with ultrasonic waves, approximately 10 mg of toner is added a little at a time to the aqueous electrolyte solution and dispersed therein. The ultrasonic wave dispersion treatment is continued for a further 60 seconds. When carrying out the ultrasonic wave dispersion, the temperature of the water bath is adjusted as appropriate to a temperature of from 10° C. to 40° C.

(6) The aqueous electrolyte solution mentioned in section (5) above, in which the toner is dispersed, is added dropwise by means of a pipette to the round bottomed beaker mentioned in section (1) above, which is disposed on the sample stand, and the measurement concentration is adjusted to approximately 5%. Measurements are carried out until the number of particles measured reaches 50,000.

(7) The weight-average particle diameter (D4) is calculated by analyzing measurement data using the accompanying dedicated software. The "average diameter" on the "Analysis/volume-based statistical values (arithmetic mean)" screen is weight-average particle diameter (D4) when the condition is set to graph/vol. % in the dedicated software.

Method for Measuring the True Density of the Toner and External Additive

The true density of the toner and external additive is measured using an "AccuPyc 1330" dry automatic pycnometer from Shimadzu Corporation; the measurement is carried out in accordance with the operating manual provided with the instrument.

Method for Separating the External Additive From the Toner Particle

If the external additive used for external addition can be acquired, the aforementioned measurements may be carried out using this. When external additive separated from the toner particle surface is to be used as the measurement sample, separation of the external additive from the toner particle is carried out using the following procedure.

(1) For the Case of Magnetic Toner

A dispersion medium is first prepared by introducing 6 mL of Contaminon N (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.) into 100 mL of deionized water. 5 g of the toner is added to this dispersion medium and dispersion is carried out for 5 minutes using an ultrasound disperser (VS-150, As One Corporation). This is followed by placement in a "KM Shaker" (model: V. SX) from Iwaki Industry Co., Ltd., and shaking is performed for 20 minutes at 350 excursions per minute.

The toner particles are then immobilized using a neodymium magnet and the supernatant is collected. The external additive is collected by drying this supernatant. This procedure is repeated when a satisfactory amount of external additive cannot be collected.

When several types of external additives are used, the external additives should be sorted from the collected external additive using, for example, a centrifugal separation procedure.

(2) For the Case of Nonmagnetic Toner

A sucrose concentrate is prepared by the addition of 160 g of sucrose (Kishida Chemical Co., Ltd.) to 100 mL of deionized water and dissolution while heating on a water bath. 31 g of this sucrose concentrate and 6 mL of Contaminon N are introduced into a centrifugal separation tube to prepare a dispersion. 1 g of the toner is added to this dispersion, and clumps of the toner are broken up using, for example, a spatula.

The centrifugal separation tube is shaken for 20 minutes at 350 excursions per minute using the aforementioned shaker. After shaking, the solution is transferred over to a glass tube (50 mL) for swing rotor service, and centrifugal separation is performed with a centrifugal separator (H-9R, Kokusan Co., Ltd.) using conditions of 3,500 rpm and 30 minutes. In the glass tube after centrifugation separation, the toner is present in the uppermost layer and the external additive is present in the lower layer aqueous solution. The lower layer aqueous solution is recovered; centrifugal separation is performed to separate the sucrose from the external additive; and the external additive is collected. Centrifugal separation may be carried out repeatedly as necessary, and, once a satisfactory separation has been obtained, the dispersion is dried and the external additive is collected.

As with the case of magnetic toner, when a plurality of external additives are used, the external additives are sorted from the recovered external additive using, for example, a centrifugal separation procedure.

EXAMPLES

The present invention is more specifically described herebelow using examples. The present invention is not limited by the examples that follow.

Toner Particle Production Example

Toner Particle 1 Production Example

The Toner Particle 1 Production Example is described in the following.

Preparation of Binder Resin Particle Dispersion 89.5 parts of styrene, 9.2 parts of butyl acrylate, 1.3 parts of acrylic acid, and 3.2 parts of n-lauryl mercaptan were mixed and dissolved. To this solution was added an aqueous solution of 1.5 parts of Neogen RK (Dai-ichi Kogyo Seiyaku Co., Ltd.) in 150 parts of deionized water and dispersion was carried out. While slowly stirring for 10 minutes, an aqueous solution of 0.3 parts of potassium persulfate dissolved in 10 parts of deionized water was also added. After substitution with nitrogen, an emulsion polymerization was run for 6 hours at 70° C. After the completion of polymerization, the reaction solution was cooled to room temperature and deionized water was added to obtain a binder resin particle dispersion having a solids fraction concentration of 12.5 mass % and a median diameter of 0.2 μm on a volume basis.

Preparation of Release Agent Dispersion 100 parts of a release agent (behenyl behenate, melting point: 72.1° C.) and 15 parts of Neogen RK were mixed in 385 parts of deionized water and a release agent dispersion was obtained by dispersing for approximately 1 hour using a JN100 wet jet mill (JOKOH Co., Ltd.). The concentration of the release agent in the release agent dispersion was 20 mass %.

Preparation of Colorant Dispersion 100 parts of "Nipex 35" (Orion Engineered Carbons LLC) carbon black as colorant and 15 parts of Neogen RK were mixed in 885 parts of deionized water and a colorant dispersion was obtained by dispersing for approximately 1 hour using a JN100 wet jet mill.

Toner Particle 1 Preparation 265 parts of the binder resin particle dispersion, 10 parts of the release agent dispersion, and 10 parts of the colorant dispersion were dispersed using a homogenizer (Ultra-Turrax T50, IKA). The temperature in the container was adjusted to 30° C. while stirring and the pH was adjusted to 5.0 by the addition of 1 mol/L hydrochloric acid. Heating was begun after standing for 3 minutes, and the temperature was raised to 50° C. to carry out the production of associated particles.

The particle diameter of the associated particles in this state was measured using a "Coulter Counter Multisizer 3" (registered trademark, Beckman Coulter, Inc.). At the point at which the weight-average particle diameter reached 6.2 μm, the pH was adjusted to 8.0 by the addition of a 1 mol/L aqueous sodium hydroxide solution to stop particle growth.

This was followed by heating to 95° C. to carry out melt adhesion and sphericization of the associated particles. Cooling was begun when the average circularity reached 0.980, and cooling to 30° C. then provided a toner particle dispersion 1.

Hydrochloric acid was added to the resulting toner particle dispersion 1 to adjust the pH to 1.5 or below; holding was carried out for 1 hour while stirring; and solid/liquid separation was subsequently performed on a pressure filter to obtain a toner cake. This was reslurried with deionized water to provide another dispersion, followed by solid/liquid separation on the aforementioned filter. Reslurrying and solid/liquid separation were continued until the electrical conductivity of the filtrate became 5.0 μS/cm or less, and the final solid/liquid separation provided a toner cake.

The obtained toner cake was dried using a Flash Jet Dryer (Seishin Enterprise Co., Ltd.), an air-current dryer. The drying conditions were as follows: an injection temperature of 90° C., a dryer outlet temperature of 40° C., and a toner cake feed rate adjusted in conformity with the moisture content of the toner cake to a rate at which the outlet temperature did not deviate from 40° C. The fines and coarse powder were then cut using a Coanda effect-based multigrade classifier to obtain a toner particle 1.

Silica Fine Particles

The silica fine particles described in the following were used.

(Silica Fine Particle 1)

100 parts of dry silica fine particles [BET specific surface area=300 $m^2/g$] were subjected to a hydrophobic treatment with 25 parts of a dimethylsilicone oil (viscosity=100 $mm^2/s$).

(Silica Fine Particle 2)

100 parts of dry silica fine particles [BET specific surface area=150 $m^2/g$] were subjected to a hydrophobic treatment with 20 parts of a dimethylsilicone oil (viscosity=100 $mm^2/s$).

(Silica Fine Particle 3)

100 parts of dry silica fine particles [BET specific surface area=90 $m^2/g$] were subjected to a hydrophobic treatment with 2 parts of hexamethyldisilazane (HMDS) and 10 parts of a dimethylsilicone oil (viscosity=100 $mm^2/s$).

(Silica Fine Particle 4)

100 parts of dry silica fine particles [BET specific surface area=50 $m^2/g$] were subjected to a hydrophobic treatment with 1.2 parts of hexamethyldisilazane (HMDS).

Toner Production Examples

Toner 1 Production Example

Using the apparatus shown in FIG. 8, an external addition/mixing process was carried out on the toner particle 1 obtained in the Toner Particle 1 Production Example.

This example used the apparatus shown in FIG. 8 having a diameter for the inner circumference of the main casing 18 of 130 mm and a volume for the processing space 9 of $2.0\times10^{-3}$ $m^3$; the rated power of the drive member 8 was 5.5 kW and the stirring member 20 had the shape depicted in FIG. 9. The overlap width d between the stirring member 20*a* and the stirring member 20*b* in FIG. 9 was 0.25 D with reference to the maximum width D of the stirring member 20, and the clearance between the stirring member 20 and the inner circumference of the main casing 18 was 3.0 mm.

100 parts of toner particle 1 and 2.5 parts of silica fine particle 2 were introduced into the apparatus given in FIG. 8 having the apparatus structure described above.

After the introduction of the toner particles and silica fine particles, a pre-mixing was performed in order to uniformly mix the toner particles with the silica fine particles. The pre-mixing conditions were as follows: 0.1 W/g (rotation rate of 150 rpm by the drive member 8) for the drive member 8 power, 1 minute for the processing time.

An external addition/mixing process was carried out after the completion of the pre-mixing. With regard to the conditions for the external addition/mixing process, the peripheral velocity of the outermost tip of the stirring member 20 was adjusted so as to maintain the drive power from the drive member 8 constant at 0.6 W/g (rotation rate of 1,400 rpm by the drive member 8); the processing time was 5 minutes.

After the external addition/mixing process, toner 1 was obtained by removing the coarse particles and so forth using a circular vibrating screen equipped with a screen having a diameter of 500 mm and an aperture of 75 μm. The number-average primary particle diameter of the silica fine particles on the toner surface was measured at 15 nm when toner 1 was submitted to magnified observation using a scanning electron microscope. The external addition conditions and properties for toner 1 are given in Table 1-1.

Toners 2 to 12 Production Example

Toners 2 to 12 were obtained proceeding as in the Toner 1 Production Example, but changing the type and number of parts of addition of the silica fine particles and the external addition conditions in the Toner 1 Production Example as shown in Tables 1-1 and 1-2.

DHT-4A from Kyowa Chemical Industry Co., Ltd. was used for the hydrotalcite compound in toner 9. 0.2 parts of the hydrotalcite compound per 100 parts of toner particle 1 was added along with the silica fine particles in the case of toner 9, and external addition was carried out using the apparatus shown in FIG. 8.

For toner 12, a Henschel mixer (product name) was used as the external addition apparatus in place of the apparatus shown in FIG. 8, and external addition was performed using the following conditions.

peripheral velocity: 30 m/s, mixing time: 10 minutes

TABLE 1-1

| Silica fine particles | | Toner 1 Silica fine particle 2 | Toner 2 Silica fine particle 1 | Toner 3 Silica fine particle 3 | Toner 4 Silica fine particle 2 | Toner 5 Silica fine particle 2 | Toner 6 Silica fine particle 2 |
|---|---|---|---|---|---|---|---|
| Number of parts of addition of silica fine particles (parts) | | 2.5 | 2.5 | 2.5 | 1.5 | 1.9 | 1.7 |
| pt: true density of toner ($g/cm^3$) | | 1.1 | 1.1 | 1.1 | 1.1 | 1.1 | 1.1 |
| pa: true density of silica fine particles ($g/cm^3$) | | 2.2 | 2.2 | 2.2 | 2.2 | 2.2 | 2.2 |
| dt: weight-average particle diameter of toner (μm) | | 6.3 | 6.3 | 6.3 | 6.3 | 6.3 | 6.3 |
| da: number-average particle diameter of silica fine particles (nm) | | 15 | 7 | 20 | 15 | 15 | 15 |
| Number of parts of addition of external additive (parts) | | 2.5 | 2.5 | 2.5 | 1.5 | 1.9 | 1.7 |
| Theoretical coverage ratio X2 (area %) | | 141 | 303 | 106 | 86 | 108 | 97 |
| Coverage ratio X1 (area %) | | 74 | 81 | 69 | 53 | 62 | 58 |
| Spreading index X1/X2 | | 0.52 | 0.27 | 0.65 | 0.62 | 0.57 | 0.60 |
| Value of −0.0042 × X1 + 0.60 | | 0.29 | 0.26 | 0.31 | 0.38 | 0.34 | 0.36 |
| Immobilization percentage F (%) | | 80 | 85 | 75 | 86 | 83 | 84 |
| External addition apparatus | Apparatus | FIG. 8 | FIG. 8 | FIG. 8 | FIG. 8 | FIG. 8 | FIG. 8 |
| | Pre-mixing (W/g) | 0.1 | 0.1 | 0.1 | 0.1 | 0.1 | 0.1 |
| | External addition process (W/g) | 0.6 | 0.6 | 0.6 | 0.6 | 0.6 | 0.6 |
| Hydrotalcite compound | | None | None | None | None | None | None |

TABLE 1-2

| Silica fine particles | Toner 7 Silica fine particle 2 | Toner 8 Silica fine particle 2 | Toner 9 Silica fine particle 2 | Toner 10 Silica fine particle 4 | Toner 11 Silica fine particle 2 | Toner 12 Silica fine particle 1 |
|---|---|---|---|---|---|---|
| Number of parts of addition of silica fine particles (parts) | 2.5 | 2.5 | 2.5 | 2.5 | 1.1 | 2.5 |
| pt: true density of toner ($g/cm^3$) | 1.1 | 1.1 | 1.1 | 1.1 | 1.1 | 1.1 |
| pa: true density of silica fine particles ($g/cm^3$) | 2.2 | 2.2 | 2.2 | 2.2 | 2.2 | 2.2 |
| dt: weight-average particle diameter of toner (μm) | 6.3 | 6.3 | 6.3 | 6.3 | 6.3 | 6.3 |
| da: number-average particle diameter of silica fine particles (nm) | 15 | 15 | 15 | 30 | 15 | 7 |
| Number of parts of addition of external additive (parts) | 2.5 | 2.5 | 2.7 | 2.5 | 1.1 | 2.5 |
| Theoretical coverage ratio X2 (area %) | 141 | 141 | 141 | 71 | 63 | 303 |
| Coverage ratio X1 (area %) | 71 | 65 | 74 | 52 | 45 | 73 |
| Spreading index X1/X2 | 0.50 | 0.46 | 0.52 | 0.74 | 0.71 | 0.24 |
| Value of −0.0042 × X1 + 0.60 | 0.30 | 0.33 | 0.29 | 0.38 | 0.41 | 0.29 |
| Immobilization percentage F (%) | 76 | 70 | 80 | 69 | 64 | 73 |

TABLE 1-2-continued

| Silica fine particles | | Toner 7 Silica fine particle 2 | Toner 8 Silica fine particle 2 | Toner 9 Silica fine particle 2 | Toner 10 Silica fine particle 4 | Toner 11 Silica fine particle 2 | Toner 12 Silica fine particle 1 |
|---|---|---|---|---|---|---|---|
| Externa addition apparatus | Apparatus | FIG. 8 | FIG. 8 | FIG. 8 | FIG. 8 | FIG. 8 | Henschel mixer |
| | Pre-mixing (W/g) | 0.06 | 0.1 | 0.1 | 0.1 | 0.1 | Henschel mixer |
| | External addition process (W/g) | 0.6 | 0.47 | 0.6 | 0.6 | 0.6 | Henschel mixer |
| Hydrotalcite compound | | None | None | Present | None | None | None |

Cleaning Blade Production Examples

Cleaning Blade 1 Production Example

Support Member

A 1.6 mm-thick zinc-plated steel sheet was prepared and was processed to yield a support member having an L-shaped cross section as shown for the support member 3 in FIG. 2.

The location on this support member for contact with the elastic member was coated with an adhesive (product name: Chemlok 219, Lord Corporation) for bonding polyurethane resins.

Preparation of Starting Materials for the Elastic Member

| | |
|---|---|
| 4,4'-diphenylmethane diisocyanate (product name: Millionate MT, Tosoh Corporation) (Millionate MT is also referred to as 4,4'-MDI in the following) | 345.5 parts |
| polymeric MDI (product name: Millionate MR-400, Tosoh Corporation) (Millionate MR-400 is also referred to as MR400 in the following) | 20.0 parts |
| polyol (butylene adipate polyester polyol having a number-average molecular weight of 2,500, product name: Nippolan 3027, Tosoh Corporation) (Nippolan 3027 is also referred to as PBA2500 in the following) | 634.5 parts |

These materials were reacted for 3 hours at 80° C. to obtain a prepolymer having an NCO isocyanate content of 36.6 mass %.

The following materials were than blended to prepare a curing agent.

| | |
|---|---|
| 1,4-butanediol (Tokyo Chemical Industry Co., Ltd,) (1,4-butanediol is also referred to as 1,4-BD in the following) | 7.0 parts |
| triol (Tokyo Chemical Industry Co., Ltd., glycerol) | 42.2 parts |
| polyol (hexylene adipate polyester polyol having a number-average molecular weight of 1,000, product name: Nippolan 164, Tosoh Corporation) (Nippolan 164 is also referred to as PHA1000 in the following) | 302.7 parts |
| Polycat46 (product name, Air Products Japan, Inc.) | 0.13 parts |
| N,N'-dimethylhexanolamine (product name: Kaolizer No. 25, Kao Corporation) (Kaolizer No. 25 is also referred to as No. 25 in the following) | 0.55 parts |

The resulting mixture (curing agent) was added to and mixed with the prepolymer described above to yield a polyurethane elastomer composition.

The adhesive-coated location of the support member was placed so as to project out in the interior of the cavity of a cleaning blade molding die. The polyurethane elastomer composition was injected into the cleaning blade molding die and curing was carried out for 2 minutes at 130° C.; subsequent removal from the die yielded a molding in which polyurethane and the support member were integrated into a single article.

The die was coated with a release agent A prior to injection of the polyurethane elastomer composition. The release agent provided by mixing the following materials was used as release agent A.

| | |
|---|---|
| ELEMENT14 PDMS 1000-JC (product name, Momentive Performance Materials Inc.) | 5.06 parts |
| ELEMENT14 PDMS 10K-JC (product name, Momentive Performance Materials Inc.) | 6.19 parts |
| SR1000 (product name, Momentive Performance Materials Inc.) | 3.75 parts |
| EXXSOL DSP145/160 (product name, Andoh Parachemie Co., Ltd.) | 85 parts |

This integrated single article was suitably sectioned to provide an edge angle of 90° and 7.5 mm, 1.8 mm, and 240 mm for the distances, respectively, in the short direction, thickness direction, and long direction of the polyurethane. The properties of the obtained cleaning blade 1 are given in Table 2-1.

Cleaning Blades 2 and 3 Production Example

Cleaning blades 2 and 3 were obtained proceeding as for the cleaning blade 1, but changing the prepolymer composition and the curing agent composition in accordance with Table 2-1. The TMP in Table 2-1 indicates trimethylolpropane. The properties of the obtained cleaning blades 2 and 3 are given in Table 2-1.

Cleaning Blade 4 Production Example

Cleaning blade 4 was obtained proceeding as for the cleaning blade 2, except that the following post-treatment was additionally performed. The properties of the resulting cleaning blade 4 are given in Table 2-1.

Using an ultraviolet irradiation treatment apparatus having an ultraviolet intensity of 32.8 mW/cm$^2$, a surface treatment was performed on the obtained cleaning blade 2; ultraviolet irradiation was performed for 120 seconds and the accumulated ultraviolet dose was 3,936 mJ/cm$^2$.

Cleaning Blade 5 Production Example

A cleaning blade was obtained proceeding as for the cleaning blade 1, but changing the prepolymer composition and curing agent composition as shown in Table 2-2. The PBA2000 in Table 2-2 represents butylene adipate polyester polyol having a number-average molecular weight of 2,000 (product name: Nippolan 4010, Tosoh Corporation). The obtained cleaning blade was subjected to a secondary curing for 60 minutes at 130° C., followed by immersion of 2 mm of the tip of the elastic member for 10 seconds in 4,4'-MDI that had been melted at 80° C. After the immersion, the 4,4'-MDI adhered to the blade surface was washed with butyl acetate. After washing, ageing for 24 hours yielded the surface-treated cleaning blade 5. The properties of the obtained cleaning blade 5 are given in Table 2-2.

Cleaning Blade 6 Production Example

A cleaning blade was obtained proceeding as for the cleaning blade 1, but changing the prepolymer composition and curing agent composition as shown in Table 2-2. A cleaning blade 6 was obtained by subjecting the resulting cleaning blade to a surface treatment using an ultraviolet irradiation treatment apparatus having an ultraviolet intensity of 32.8 mW/cm$^2$; ultraviolet irradiation was performed for 150 seconds and the accumulated ultraviolet dose was 4,920 mJ/cm$^2$. The properties of the obtained cleaning blade 6 are given in Table 2-2.

Cleaning Blade 7 Production Example

A polyurethane elastomer composition was obtained proceeding as for the cleaning blade 1, but changing the prepolymer composition and curing agent composition as shown in Table 2-2. The PBA2000 in Table 2-2 represents butylene adipate polyester polyol having a number-average molecular weight of 2,000 (product name: Nippolan 4010, Tosoh Corporation).

The polyurethane elastomer composition was injected into a die as for the cleaning blade 1; curing was carried out for 10 minutes at 130° C. followed by removal from the die; and a cleaning blade 7 was obtained proceeding as for the cleaning blade 1, but with the execution of a secondary cure for 60 minutes at 130° C. The properties of the obtained cleaning blade 7 are given in Table 2-2.

Cleaning Blade 8 Production Example

A polyurethane elastomer composition was obtained proceeding as for the cleaning blade 1, but changing the prepolymer composition and curing agent composition as shown in Table 2-2.

The polyurethane elastomer composition was injected into a die as for the cleaning blade 1; curing was carried out for 10 minutes at 130° C. followed by removal from the die; and a secondary cure for 60 minutes at 130° C. was carried out to yield an integrated molded article of polyurethane and the support member.

The resulting integrated molded article was sectioned as for the cleaning blade 1, and 2 mm of the tip of the elastic member was immersed for 10 seconds in 4,4'-MDI that had been melted at 80° C. After the immersion, the 4,4'-MDI adhered to the blade surface was washed with butyl acetate. After washing, heating was performed for 30 minutes at 100° C. followed by ageing for 24 hours to yield the surface-treated cleaning blade 8.

The properties of the obtained cleaning blade 8 are given in Table 2-2.

TABLE 2-1

| | | | Cleaning blade 1 | Cleaning blade 2 | Cleaning blade 3 | Cleaning blade 4 |
|---|---|---|---|---|---|---|
| Composition | Prepolymer | Amount of 4,4'-MDI (parts) | 345.5 | 187.5 | 345.5 | 187.5 |
| | | Polymeric MDI type | MR400 | MR400 | MR400 | MR400 |
| | | Amount of polymeric MDI (parts) | 20.0 | 220.0 | 20.0 | 220.0 |
| | | Polyol type | PBA2500 | PBA2500 | PBA2500 | PBA2500 |
| | | Amount of polyol (parts) | 634.5 | 592.5 | 634.5 | 592.5 |
| | Curing agent | Triol type | Glycerol | TMP | Glycerol | TMP |
| | | Amount of triol (parts) | 42.2 | 63.8 | 26.9 | 63.8 |
| | | Amount of 1,4-BD (parts) | 7.0 | 0.0 | 10.7 | 0.0 |
| | | Polyol type | PHA1000 | PHA1000 | PHA1000 | PHA1000 |
| | | Amount of polyol (parts) | 302.7 | 255.3 | 275.7 | 255.3 |
| | | Amount of Polycat 46 (parts) | 0.13 | 0.13 | 0.13 | 0.13 |
| | | No. 25 (parts) | 0.55 | 0.55 | 0.55 | 0.55 |
| Post-treatment (surface treatment) | | | None | None | None | Accumulated UV dose of 3,936 mJ/cm$^2$ |
| Adhesive | | | Chemlok 219 | Chemlok 219 | Chemlok 219 | Chemlok 219 |
| Release agent | | | A | A | A | A |
| Elastic modulus | | Average value (MPa) | 16 | 60 | 17 | 463 |
| | | Standard deviation (MPa) | 0.74 | 2.02 | 0.8 | 22.2 |
| | | Coefficient of variation (%) | 4.6 | 3.4 | 4.7 | 4.8 |
| Martens hardness | | \|HM1-HM2\| (N/mm$^2$) | 0.02 | 0.08 | 0.02 | 0.08 |

TABLE 2-2

| | | | Cleaning blade 5 | Cleaning blade 6 | Cleaning blade 7 | Cleaning blade 8 |
|---|---|---|---|---|---|---|
| Composition | Prepolymer | Amount of 4,4'-MDI (parts) | 296.6 | 334.7 | 296.6 | 296.6 |
| | | Polymeric MDI type | — | — | — | — |
| | | Amount of polymeric MDI (parts) | 0 | 0 | 0 | 0 |
| | | Polyol type | PBA2000 | PBA2500 | PBA2000 | PBA2000 |
| | | Amount of polyol (parts) | 703.4 | 665.3 | 703.4 | 703.4 |
| | Curing agent | Triol type | Glycerol | Glycerol | Glycerol | Glycerol |
| | | Amount of triol (parts) | 15.5 | 15.5 | 20.3 | 15.5 |
| | | Amount of 1,4-BD (parts) | 62.0 | 19.4 | 54.9 | 62 |
| | | Polyol type | — | PBA1000 | — | — |
| | | Amount of polyol (parts) | 0 | 159.0 | 0 | 0 |
| | | Amount of Polycat 46 (parts) | 0 | 0.13 | 0 | 0 |
| | | No. 25 (parts) | 0.23 | 0.55 | 0.23 | 0.23 |
| Post-treatment (surface treatment) | | | Immersion in 4,4'-MDI, 80° C., 10 seconds | Accumulated UV dose of 4,920 mJ/cm$^2$ | None | Immersion in 4,4'-MDI, 80° C., 10 seconds Heating, 30 minutes, 100° C. |
| Adhesive | | | Chemlok 219 | Chemlok 219 | Chemlok 219 | Chemlok 219 |
| Release agent | | | A | A | A | A |

TABLE 2-2-continued

| | | Cleaning blade 5 | Cleaning blade 6 | Cleaning blade 7 | Cleaning blade 8 |
|---|---|---|---|---|---|
| Elastic modulus | Average value (MPa) | 452 | 518 | 10 | 50 |
| | Standard deviation (MPa) | 29.2 | 10.3 | 0.66 | 3.82 |
| | Coefficient of variation (%) | 6.5 | 2.0 | 6.6 | 7.6 |
| Martens hardness | \|HM1-HM2\| (N/mm$^2$) | 0.29 | 0.01 | 0.01 | 1.51 |

Examples 1 to 13 and Comparative Examples 1 to 6

Evaluations were performed using the evaluation methods described below and using the obtained toners 1 to 12 and cleaning blades 1 to 8. The toners and cleaning blades used in the examples and comparative examples and the results of the evaluations are given in Table 3.

Evaluation Using an LBP

A modified version of a commercial LBP9950Ci laser beam printer from Canon, Inc. was used. The modifications were as follows: the process speed was changed to 330 mm/sec by changing the gearing and software of the machine used for the evaluations; and printing using just the black station was enabled. The toner in an LBP9950Ci process cartridge was removed, the interior was cleaned with an air blower, and 150 g of the toner for evaluation was loaded. In addition, the cleaning blade for evaluation was installed in the process cartridge as the cleaning blade for the photosensitive member, which was the member to be cleaned.

In addition, this process cartridge was held for 24 hours in a high-temperature, high-humidity environment (30° C./80% RH). After the holding period, the process cartridge was installed in the black station of the LBP9950Ci and the following evaluations were performed.

Evaluation of Cleaning Performance

Operating in a high-temperature, high-humidity environment (30° C./80% RH), 10,000 prints of an image having a print percentage of 1.0% were printed out in A4 paper landscape orientation. After the 10,000 prints, 5 prints of a halftone image having a toner laid-on level of 0.2 mg/cm$^2$ were made, and a visual evaluation was performed using the following criteria. The results of the evaluation are given in Table 3.

A: There are no cleaning defects on the halftone image and the charging member is not contaminated.

B: There are no cleaning defects on the halftone image, but the charging member is contaminated.

C: A few cleaning defects can be observed on the halftone image.

D: Cleaning defects on the halftone image are conspicuous.

Evaluation of Starting Streaks

Operating in a high-temperature, high-humidity environment (30° C./80% RH) and using 75 g/m$^2$ A4 paper as the recording medium, 3,000 prints per day of 4.0% horizontal lines were made, and a total of 9,000 prints were printed out over 3 days. After the completion of the 9,000-print durability test, an evaluation was made on the morning of the 4th day. Specifically, 5 prints of a solid white image were continuously output, and the degree of starting streaking was evaluated using the following criteria. In addition, holding was carried out for 7 days under high-temperature, high-humidity conditions (30° C./80% RH), 5 prints of the solid white image were then continuously output in the same manner, and the degree of starting streaking was evaluated using the following criteria.

The results of the evaluation are given in Table 3.

A: Condition in which starting streaks are not observed in the first solid white image print.

B: Condition in which starting streaks can be faintly observed in the first solid white image print.

C: Condition in which starting streaks can be faintly observed in the first solid white print, and starting streaks can also be faintly observed, with the periodicity of the charging member, in the solid white images from the second print onward.

D: Condition in which distinct starting streaks are produced in the first solid white image print, but, in the solid white images from the second print onward, starting streaks can be observed only faintly or starting streaks are not observed.

E: Distinct starting streaks are produced in the solid white image in the first print and starting streaks are also produced in the solid white images from the second print onward.

TABLE 3

| | | | Cleaning performance | Starting streaks, at the morning of 4th day | Starting streaks, after holding for 7 days |
|---|---|---|---|---|---|
| Example 1 | Toner 1 | Cleaning blade 1 | A | A | A |
| Example 2 | Toner 1 | Cleaning blade 2 | A | A | A |
| Example 3 | Toner 1 | Cleaning blade 4 | B | C | C |
| Example 4 | Toner 1 | Cleaning blade 3 | A | B | B |
| Example 5 | Toner 1 | Cleaning blade 5 | A | A | B |
| Example 6 | Toner 2 | Cleaning blade 1 | A | B | B |
| Example 7 | Toner 3 | Cleaning blade 1 | A | B | B |
| Example 8 | Toner 4 | Cleaning blade 1 | A | B | C |
| Example 9 | Toner 5 | Cleaning blade 1 | A | A | B |
| Example 10 | Toner 6 | Cleaning blade 1 | A | B | B |
| Example 11 | Toner 7 | Cleaning blade 1 | A | A | B |
| Example 12 | Toner 8 | Cleaning blade 1 | A | B | B |
| Example 13 | Toner 9 | Cleaning blade 5 | A | A | A |
| Comparative Example 1 | Toner 1 | Cleaning blade 6 | B | C | D |
| Comparative Example 2 | Toner 1 | Cleaning blade 7 | B | C | D |
| Comparative Example 3 | Toner 1 | Cleaning blade 8 | B | C | D |
| Comparative Example 4 | Toner 10 | Cleaning blade 8 | B | D | D |
| Comparative Example 5 | Toner 11 | Cleaning blade 8 | B | D | D |
| Comparative Example 6 | Toner 12 | Cleaning blade 8 | B | D | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions. This application claims the benefit of Japanese Patent Application No. 2021-064938, filed Apr. 6, 2021, which is hereby incorporated by reference herein in its entirety.

What is claimed is:

1. An electrophotographic apparatus comprising:

an electrophotographic photosensitive member having a support and a photosensitive layer on the support;

charging unit for charging a surface of the electrophotographic photosensitive member;

exposing unit for forming a latent image on the surface of the electrophotographic photosensitive member, by irradiating the surface of the electrophotographic photosensitive member with exposing light;

developing unit containing a toner and for forming a toner image on the surface of the electrophotographic photosensitive member by developing the latent image with the toner;

transferring unit for transferring the toner image on the surface of the electrophotographic photosensitive member to a transfer material; and a cleaning blade, wherein the cleaning blade comprises a polyurethane-containing elastic member, and a support member that supports the elastic member, the cleaning blade is disposed so that a portion of the elastic member is in contact with the surface of the electrophotographic photosensitive member;

when a side of the elastic member in contact with the surface of the electrophotographic photosensitive member is defined as a tip side of the elastic member, the elastic member has a plate shape at least at the tip side, the plate shape having a main surface and a tip surface that forms a tip side edge in combination with the main surface, the main surface facing the surface of the electrophotographic photosensitive member;

assuming that, on the tip surface, a hypothetical first line segment in parallel to the tip side edge at a distance of 10 μm from the tip side edge and having the same length as the tip side edge is drawn, designating a length of the first line segment as L, and defining, in the first line segment, P1 to be a point that is (1/10)L from one end of the first line segment, P2 to be a point that is (2/10)L from the one end of the first line segment, P3 to be a point that is (3/10)L from the one end of the first line segment, P4 to be a point that is (4/10)L from the one end of the first line segment, P5 to be a point that is (5/10)L from the one end of the first line segment, P6 to be a point that is (6/10)L from the one end of the first line segment, P7 to be a point that is (7/10)L from the one end of the first line segment, P8 to be a point that is (8/10)L from the one end of the first line segment, and P9 to be a point that is (9/10)L from the one end of the first line segment, and designating, on the first line segment, a total of 630 points comprising, centered on each of P1 to P9, 70 points at each of the P1 to P9 on a 1 μm pitch, an average value of elastic modulus values obtained by measurement at each of locations of the 630 points using a scanning probe microscope is from 15 MPa to 470 MPa and coefficient of variation for the elastic modulus is not more than 7.0%;

$|HM1-HM2| \leq 0.30$ N/mm$^2$ where HM1 is Martens hardness of the elastic member measured at the location of P5 and HM2 is Martens hardness of the elastic member measured at the location that is a distance of 500 μm from the tip side edge on a bisector that is provided on supposition that a hypothetical bisector of an angle made between the main surface and the tip surface is drawn in a cross section of the elastic member that is orthogonal to the tip side edge and the tip surface that contains P5, the toner comprises a toner particle and an external additive, the external additive has a number-average primary particle diameter of 5 to 25 nm, when a coverage ratio on a surface of the toner particle by the external additive, as measured with an X-ray photoelectron spectrometer, is defined as X1, the X1 is from 50 to 85 area %, and when a theoretical coverage ratio on the surface of the toner particle by the external additive is defined as X2, a spreading index given by formula (1) below satisfies formula (2) below:

$$(1)\ \text{spreading index} = X1/X2$$

$$(2)\ \text{spreading index} \geq -0.0042 \times X1 + 0.60.$$

2. The electrophotographic apparatus according to claim 1, wherein the external additive comprises silica fine particles.

3. The electrophotographic apparatus according to claim 1, wherein the X1 is from 60 to 80 area %.

4. The electrophotographic apparatus according to claim 1, wherein the $|HM1-HM2|$ is not more than 0.10 N/mm$^2$.

5. The electrophotographic apparatus according to claim 1, wherein when an immobilization percentage of the external additive relative to the toner particle is defined as F, the F is at least 75%.

6. The electrophotographic apparatus according to claim 1, wherein the external additive further comprises a hydrotalcite compound.

7. The electrophotographic apparatus according to claim 1, wherein the spreading index is 0.51 to 0.56, and a value of $-0.0042 \times X1 + 0.60$ is 0.25 to 0.35.

8. A process cartridge detachably disposed in an apparatus main body of an electrophotographic apparatus, the process cartridge comprising:

an electrophotographic photosensitive member having a support and a photosensitive layer on the support;

a developing unit containing a toner and for forming a toner image on a surface of the electrophotographic photosensitive member by developing a latent image formed on the surface of the electrophotographic photosensitive member with the toner; and a cleaning blade, wherein the cleaning blade comprises a polyurethane-containing elastic member, and a support member that supports the elastic member, the cleaning blade is disposed so that a portion of the elastic member is in contact with the surface of the electrophotographic photosensitive member, when a side of the elastic member in contact with the surface of the electrophotographic photosensitive member is defined as a tip side of the elastic member the elastic member has a plate shape at least at said tip side, the plate shape having a main surface and a tip surface that forms a tip side edge in combination with the main surface, the main surface facing the surface of the electrophotographic photosensitive member;

assuming that, on the tip surface, a hypothetical first line segment in parallel to the tip side edge at a distance of 10 μm from the tip side edge and having the same length as the tip side edge is drawn, designating a length of the first line segment as L, and defining, in the first line segment, P1 to be a point that is (1/10)L from one end of the first line segment, P2 to be a point that is (2/10)L from the one end of the first line segment, P3 to be a point that is (3/10)L from the one end of the first line segment, P4 to be a point that is (4/10)L from the one end of the first line segment, P5 to be a point that is (5/10)L from the one end of the first line segment, P6 to be a point that is (6/10)L from the one end of the first line segment, P7 to be a point that is (7/10)L from the one end of the first line segment, P8 to be a point that is (8/10)L from the one end of the first line segment, and P9 to be a point that is (9/10)L from the one end of the first line segment, and designating, on the first line segment, a total of 630 points comprising, centered on each of P1 to P9, of 70 points at each of the P1 to P9 on a 1 μm pitch, an average value of elastic modulus values obtained by measurement at each of locations of the 630 points using a scanning probe microscope is from 15 MPa to 470 MPa and coefficient of variation for the elastic modulus is not more than 7.0%, $|HM1-HM2| \leq 0.30$ N/mm$^2$ where HM1 is Martens hardness of the elastic member measured at the location of P5 and HM2 is Martens hardness of the elastic member measured at the location that is a distance of 500 μm from the tip side edge on a bisector that is provided on supposition that a hypothetical bisector of an angle made between the main surface and the tip surface is drawn in a cross section of the elastic member that is orthogonal to the tip side edge and the tip surface that contains P5, the toner comprises a toner particle and an external additive, the external additive has a number-average primary particle diameter of 5 to 25 nm;

when a coverage ratio on a surface of the toner particle by the external additive, as measured with an X-ray photoelectron spectrometer, is defined as X1, the X1 is from 50 to 85 area %, and when a theoretical coverage ratio on the surface of the toner particle by the external additive is defined as X2, a spreading index given by formula (1) below satisfies formula (2) below:

(1) spreading index$=X1/X2$ (2) spreading index$\geq -0.0042 \times X1+0.60$.

* * * * *